US007854671B2

(12) United States Patent
Lalvani

(10) Patent No.: US 7,854,671 B2
(45) Date of Patent: Dec. 21, 2010

(54) SPORTS BALL

(76) Inventor: Haresh Lalvani, 164 Bank St., Apt. 2B, New York, NY (US) 10014

( * ) Notice: Subject to any disclaimer, the term of this patent is extended or adjusted under 35 U.S.C. 154(b) by 263 days.

(21) Appl. No.: 11/796,734

(22) Filed: Apr. 26, 2007

(65) Prior Publication Data

US 2008/0268989 A1 Oct. 30, 2008

(51) Int. Cl.
*A63B 39/08* (2006.01)

(52) U.S. Cl. ..... 473/598; 473/601; 473/603; 473/604; 473/607

(58) Field of Classification Search ..... 473/598–604, 473/607
See application file for complete search history.

(56) References Cited

U.S. PATENT DOCUMENTS

| | | | | |
|---|---|---|---|---|
| 79,719 | A | 7/1868 | Alden | 473/602 |
| 175,172 | A | 3/1876 | Ryan | 473/598 |
| 187,848 | A | 2/1877 | Hale | 473/598 |
| 240,327 | A | 4/1881 | O'Donnell | 473/598 |
| 526,136 | A | 9/1894 | Thomlinson | 473/599 |
| 568,871 | A | 10/1896 | Nisbet | 473/599 |
| 978,250 | A | 12/1910 | Whitley | 473/602 |
| 1,187,029 | A | 6/1916 | Beebout | 473/604 |
| D58,166 | S | 6/1921 | Tomlinson | D21/713 |
| 1,438,226 | A | 12/1922 | Edwards | 473/607 |
| 1,546,024 | A | 7/1925 | Reichenbach | 273/160 |
| 1,646,347 | A | 10/1927 | Collette | 473/599 |
| 1,705,096 | A | 3/1929 | Pierce | 473/599 |
| 1,890,566 | A | 12/1932 | Bartky | 473/599 |

(Continued)

FOREIGN PATENT DOCUMENTS

DE 195 35 636 3/1997

(Continued)

OTHER PUBLICATIONS

"Higher Genus 'Soccer Balls' Picture Page", Rose-Hulman Institute of Technology, available at http://www.rose-hulman.edu/~brought/Epubs/soccer/soccerpics.html (Apr. 21, 2001), last accessed Sep. 25, 2006.

(Continued)

*Primary Examiner*—Gene Kim
*Assistant Examiner*—Joseph B Baldori
(74) *Attorney, Agent, or Firm*—Davidson, Davidson & Kappel, LLC

(57) ABSTRACT

New designs for a sports ball comprising at least two polygonal panels and having an improved performance and uniformity. Each panel has doubly-curved edges that curve along and across the surface of the sphere. The panels are p-sided curved polygons, where p is an integer greater than 1. The single panels, in an imagined flattened state, have curved edges where each edge curves inwards, outwards or undulates in a wave-like manner. The edges are arranged so each individual panel is without mirror-symmetry and the edge curvatures are adjusted so the panel shape can be varied to achieve more uniform panel stiffness as well as economy in manufacturing. The ball also has a possible shape-induced spin due to the panel design and the overall rotational symmetry of the design. In various embodiments, the ball comprises at least two multi-paneled layers that are topological duals of each other, wherein each layer provides a compensatory function with respect to the other layer such that the ball has a uniformly performing surface. Applications include but are not limited to designs for soccer balls, baseballs, basketballs, tennis balls, rugby, and other sports or recreational play. The shape of the ball can be spherical, ellipsoidal or other curved convex shapes.

7 Claims, 24 Drawing Sheets

U.S. PATENT DOCUMENTS

| | | | | | |
|---|---|---|---|---|---|
| 1,931,429 | A | | 10/1933 | Buckner et al. | 473/596 |
| D91,919 | S | | 4/1934 | Burbank | D21/708 |
| 2,091,455 | A | | 8/1937 | Riddell | 473/604 |
| D107,939 | S | | 1/1938 | Ball | D21/713 |
| 2,380,370 | A | * | 7/1945 | Smith, Jr. | 473/610 |
| 3,199,871 | A | | 8/1965 | Dorn | 473/609 |
| 3,508,750 | A | | 4/1970 | Henderson | 473/605 |
| D232,957 | S | | 9/1974 | Kahelin | D21/713 |
| D281,521 | S | | 11/1985 | Stalberger, Jr. et al. | D21/713 |
| D290,632 | S | | 6/1987 | Dehnert et al. | D21/714 |
| D292,014 | S | * | 9/1987 | Stalberger et al. | D21/713 |
| 4,772,020 | A | * | 9/1988 | Martin | 473/613 |
| D299,845 | S | * | 2/1989 | Gray | D21/713 |
| D299,940 | S | | 2/1989 | Fitzgerald et al. | D21/713 |
| 4,830,373 | A | | 5/1989 | Dehnert et al. | 473/599 |
| 4,856,781 | A | | 8/1989 | Shishido et al. | 473/603 |
| 5,133,550 | A | | 7/1992 | Handy | 473/596 |
| D341,869 | S | | 11/1993 | Louez | D21/713 |
| 5,470,060 | A | | 11/1995 | Spiegel | 473/599 |
| 5,603,497 | A | * | 2/1997 | Louez | 473/609 |
| 5,709,623 | A | | 1/1998 | Schwaner | 473/604 |
| D393,030 | S | | 3/1998 | Mills | D21/713 |
| 5,820,501 | A | | 10/1998 | Soofi | 473/599 |
| D405,486 | S | | 2/1999 | Chan | D21/713 |
| D408,877 | S | | 4/1999 | Sonntag et al. | D21/713 |
| D416,961 | S | | 11/1999 | Sonntag et al. | D21/713 |
| D422,040 | S | * | 3/2000 | Stalberger, Jr. | D21/713 |
| 6,287,226 | B1 | | 9/2001 | Dilling | |
| 6,302,815 | B1 | | 10/2001 | Shishido et al. | 473/604 |
| D482,418 | S | * | 11/2003 | Estefano | D21/713 |
| 6,719,653 | B1 | * | 4/2004 | Nesbitt | 473/600 |
| 6,752,732 | B2 | | 6/2004 | Morrison et al. | 473/604 |
| 6,916,263 | B1 | | 7/2005 | Pacheco | 473/607 |
| D510,113 | S | | 9/2005 | Kelly | D21/713 |
| 6,971,965 | B1 | | 12/2005 | Shishido | 473/604 |
| 6,988,969 | B2 | | 1/2006 | Avis | 473/599 |
| 2003/0045385 | A1 | | 3/2003 | Murphy et al. | |
| 2003/0078119 | A1 | | 4/2003 | Shishido et al. | 473/605 |
| 2004/0144477 | A1 | | 7/2004 | Taniguchi et al. | 156/147 |
| 2005/0266943 | A1 | | 12/2005 | Lin | |
| 2007/0049434 | A1 | | 3/2007 | Maziarz et al. | |

FOREIGN PATENT DOCUMENTS

| | | |
|---|---|---|
| DE | 199 04 766 | 8/2000 |
| DE | 199 04 771 | 8/2000 |
| DE | 199 05 044 | 8/2000 |
| DE | 199 05 045 | 8/2000 |
| DE | 199 05 046 | 8/2000 |
| EP | 1 424 105 | 6/2004 |
| ES | 294428 | 5/1986 |
| NL | 1006300 | 12/1998 |
| NL | 1009944 | 2/2000 |
| WO | WO 00/09218 | 2/2000 |
| WO | WO 2004/018053 | 3/2004 |

OTHER PUBLICATIONS

The 2006 soccer ball by Adidas—with the interior and exterior layers visible.

* cited by examiner

SPORTS BALL

BACKGROUND

The invention of a ball for various sports and recreational play is one of those universal inventions that have brought a wide range of emotions (joy, pride, disappointment, sense of accomplishment, etc.) to both players and spectators alike through the ages in addition to the basic benefit of good health and physique for those actively involved. Though most sports can be distinguished by their rules of play, and sizes and shapes of playing fields and surfaces, an important factor in nuances of different games is the size, shape, material and finish of the ball. Among the ball shapes, spherical balls are the most prevalent and widely used in different sports. In instances where aerodynamics is an issue, as in American football or rugby, the shape of the ball is more streamlined and pointed.

Among spherical balls, various designs can be distinguished by the number of "panels" or individual parts that comprise the ball surface. These balls, termed "multi-panel" balls, include balls of varying sizes, materials and methods of construction. Many of these, especially smaller balls, have two panels ("2-panel" balls), which are joined or formed together as in baseballs, cricket balls, field hockey balls, tennis balls, table tennis balls, etc. Some of these sports balls have a "solid" interior as in baseballs or cricket balls, while others are hollow as in tennis or ping-pong balls. Multi-panel sports balls are usually hollow and of larger size since the balls are usually made from sheet surfaces which are cut or molded in small pieces that are then joined to make a larger sphere through various techniques such as stitching or joining (welding, gluing, etc.). In some instances, like imitation soccer balls or beach balls, various multi-panel designs are graphically printed on the ball surface. Common multi-panel sports balls include the standard soccer ball with 32 panels from a mix of 20 hexagons and 12 pentagons, for example.

Multi-panel sports balls usually have more than one layer to increase its performance. An inner bladder layer may be surrounded by an exterior cover layer. An intermediate layer is added in some instances, as in the 2006 World Cup soccer ball, for example. A variety of multi-panel sports balls exist in the market and in the literature, and there is a constant need to improve the available designs for their performance, aesthetic or game-playing appeal, or branded uniqueness, for example.

SUMMARY OF THE INVENTION

A first exemplary embodiment of the present invention provides a sports ball comprising at least two identical polygonal panels. Each of the at least two polygonal panels has p side edges, p being an integer greater than 3, arranged and configured in a preselected cyclical pattern of asymmetric concave and convex side edge shapes. Alternate adjacent and contiguous ones of the p side edges alternate in shape between a concave shape and a convex shape. The p sides are arranged cyclically around vertices of the ball such that a side edge of concave shape of one of the at least two identical polygonal panels mates with a side edge of convex shape of another one of the at least two identical polygonal panels.

A second exemplary embodiment of the present invention provides a sports ball comprising at least two identical polygonal panels. Each of the at least two polygonal panels has p side edges, p being an integer greater than 2. Each of the p side edges are arranged and configured as an undulating wave segment comprising alternate concave and convex sections. The p side edges are arranged cyclically around vertices of the ball such that an undulating wave segment comprising alternate concave and convex sections of one side edge of one of the at least two identical polygonal panels mates with a corresponding undulating wave segment comprising alternate concave and convex sections of one side edge of another one of the at least two identical polygonal panels.

A third exemplary embodiment of the present invention provides a sports ball comprising an outer layer having vertices and faces and an inner layer having vertices and faces. The outer layer is a topological dual of the inner layer and orientated so the vertices of one overlay the faces of another and vice versa.

A fourth exemplary embodiment of the present invention provides a sports ball comprising at least two identical digonal panels. Each of the at least two digonal panels has two side edges. Each of the two side edges are arranged and configured as an undulating wave segment comprising alternate concave and convex sections. The two side edges are unparallel to each other and arranged cyclically around vertices of the ball such that an undulating wave segment comprising alternate concave and convex sections of one side edge of one of the at least two identical digonal panels mates with a corresponding undulating wave segment comprising alternate concave and convex sections of one side edge of another one of the at least two identical digonal panels.

A fifth exemplary embodiment of the present invention provides a sports ball comprising at least two polygonal panels. Each of the at least two polygonal panels has p side edges, p being an odd integer greater than 2, having concave and convex side edge shapes such that a side edge of concave shape of one of the at least two polygonal panels mates with a side edge of convex shape of another one of the at least two polygonal panels.

DETAILED DESCRIPTION

Figure 1:
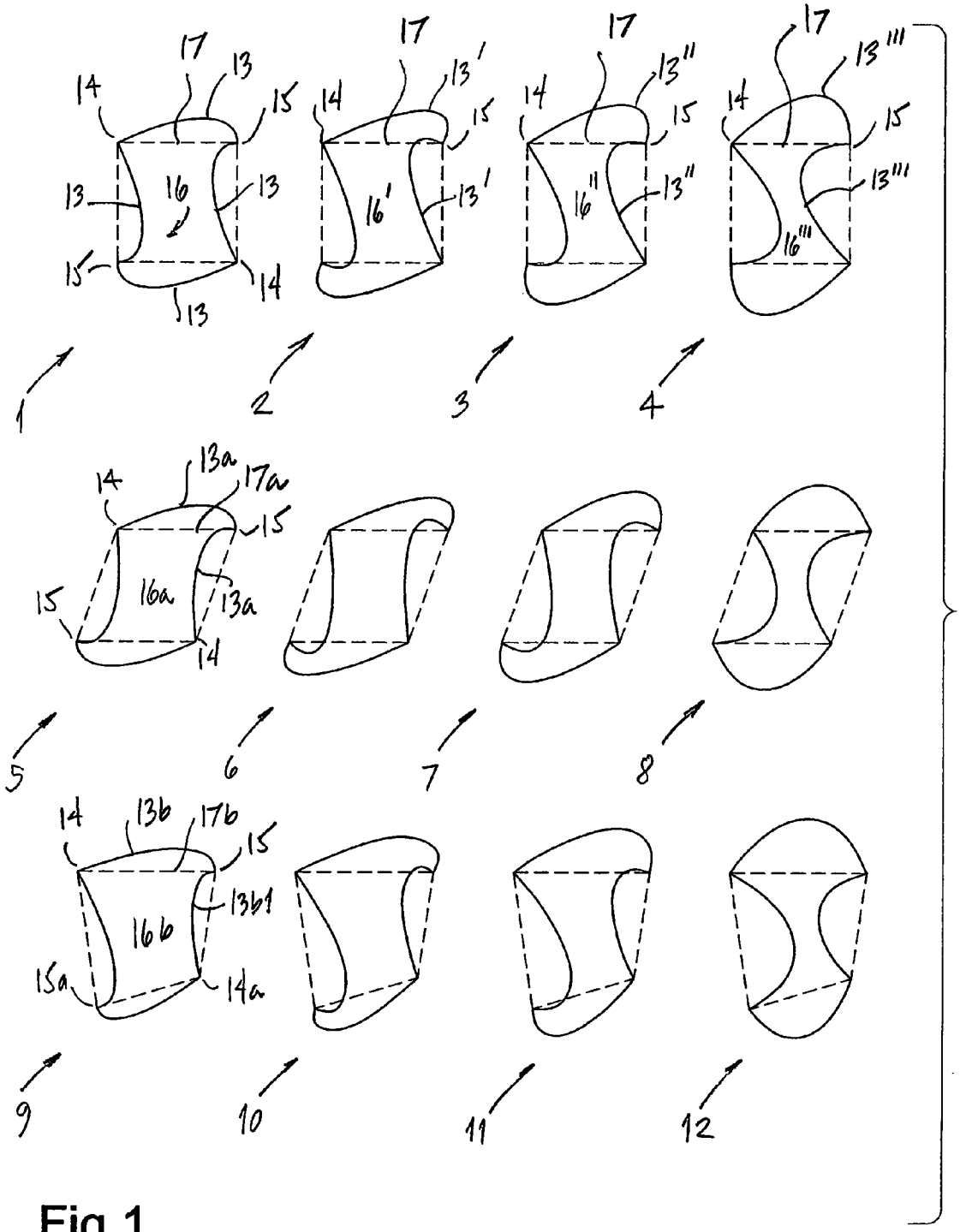
FIG. 1 shows design variations for three different types of 4-sided (p=4) panels—a square, a rhombus and a trapezoid—based on edges of Class 1.

Preferred embodiments of ball designs according to the present invention disclosed herein include designs for multi-panel sports balls, especially but not limited to soccer balls, having an exterior covering surface comprising a plurality of identical panel shapes having p sides. Designs also may be used for baseballs, tennis balls, field hockey balls, ping-pong balls, or any other type of spherical or non-spherical balls, including American footballs or rugby balls, for example.

The ball can comprise a single layer or multiple layers and may have a solid interior or a bladder or inner structure that gives the ball its shape. Single panel shape is an important criterion for uniformity of ball performance and manufacturing economy. Each p-sided panel is a polygon with p number of sides (edges) and p number of vertices. In the embodiments shown herein, each individual panel shape has no mirror-symmetry, the edges of the panels are "doubly-curved", i.e. curved along the surface of the sphere and across (i.e. perpendicular to) it as well. Two classes of such "doubly-curved" edges, Class 1 and Class 2, are disclosed herein to illustrate exemplary embodiments of the present invention. In designs with Class 1 edges, each edge curves either inwards (concave) or outwards (convex) from the center of the polygon. Class 2 edges are wavy and curve in and out in an undulating manner between adjacent vertices of a panel. Each class permits variability in the degree of edge curvatures which can be adjusted until a suitable ball design with desired stiffness, aerodynamic quality and economy in manufacturing is obtained. For example, the edge curve can be adjusted so the panel is more uniformly stiff across the surface of the ball (i.e. different regions of the panel have nearly equal stiffness) enabling a more uniform performance during play.

In preferred embodiments of the invention, both classes of edges lead to panels without any mirror-symmetry). The panels of such designs are rotationally left-handed or right-handed, depending on the orientation of the edges. In this disclosure, only rotational direction with one handedness is shown; thus for every exemplary design disclosed herein, there exists a ball design with panels with opposite handedness not illustrated here. For Class 1 designs, this requires the alternation of convex and concave edges for each panel, thereby putting a lower limit to the value of p at 4. For Class 2 designs, the undulating edges are configured cyclically (rotationally) around the panel, putting a lower limit at p=2. In addition, both classes of edges shown in these preferred embodiments are configured in such a way as to retain the overall symmetry of the ball, a requirement for uniformity in flight without wobbling. This is achieved by configuring the edges cyclically around the vertices of the panels. These features of the preferred designs, namely, the rotational symmetry in the design of individual panel shapes as well as the overall rotational symmetry of the ball, are provided to improve aerodynamic advantages to the ball as it moves through air, which may include a possible shape-induced spin on the ball in flight.

A starting geometry of ball designs disclosed herein is any known polyhedron having a single type of polygon. These include, but are not limited to, the 5 regular polyhedra known in the art, zonohedra (polyhdera having parallelograms or rhombuses), Archimedean duals (duals of semi-regular or Archimedean polyhedra), digonal polyhedra (polyhedra having 2 vertices and any number of digons or 2-sided polygons, i.e. p=2 (2-sided faces or digonal panels), meeting at these vertices), dihedral polyhedra (polyhedra having two p-sided polygons and p vertices), composite polyhedra obtained by superimposing two dual polyhedra and others. This group of shapes is here termed "source polyhedra". The source polyhedra (except dihedral polyhedra) have flat faces and straight edges, and provide the starting point for developing the geometry of spherical ball designs by various known methods of sphere-projection or spherical subdivision or spherical mapping. All faces of spherical ball designs disclosed here are portions of spheres, all edges lie on the surface of the sphere and are doubly-curved (i.e. curved both along and across the spherical surface). This makes the edges of panels curved in 3-dimensional space. Similarly, such source polyhedra also may be used as a basis for developing the geometry of ellipsoidal ball designs or other non-spherical ball designs.

A multi-panel ball comprises polygonal panels which are bound by edges and vertices. Each panel has a varying stiffness at different regions of the panel, those regions closer to an edge being stiffer than those further away, and those closer to the vertices being even stiffer than those closer to the edges. This is because the edges, usually constructed by seams between the panels, are strengthened by the seams. The vertices are even stronger since more than one seamed edge meet at each of the vertices imparting greater strength at each of the vertices. This strength is graded progressively towards the regions of the panels away from the seam edges (and vertices) so that the central region of the panel, which is furthest away from the edges (and vertices), is the weakest. This makes the surface of a multi-panel ball un-uniform.

The uniformity of the surface of a multi-panel ball is improved if the panels are shaped so that the inner regions of the polygonal panels are ideally equidistant from corresponding points on the panel edges. Improved uniformity can be achieved by varying the curvature of the panel edges such that the polygonal panels become elongated and thus have a more uniform width than polygonal panels that are more circular in shape. In these elongated panel shapes, the innermost regions of the panels are more uniformly spaced from corresponding points on the panel edges. This technique works for both Class 1 and Class 2 edges.

Geometries of single-layer balls, excluding those based on regular polyhedra and dihedral, tend to have a particular drawback of having a different number of panels meeting at adjacent vertices of the source polyhedron. This geometric constraint produces balls that do not have a uniform strength and performance when contact is made with different types of vertices during play. For example, a vertex with 5 panels surrounding it behaves differently from a vertex with 3 panels around it with respect to its strength. This particular drawback may be remedied by inserting a second layer which is the topological dual of the first layer. In such two-layer ball designs, different vertex-types on one layer are compensated by different panel types on the other layer, and vice versa, which leads to a more uniformly performing ball surface. This is accomplished by superimposing two topological duals, wherein one layer is a topological dual of the other, with the weaker locations on the exterior layer being strengthened by the stronger portions of the intermediate layer, and vice versa.

Additional layers also may be added to further improve the ball's uniformity and performance or to vary other ball characteristics, such as weight or hardness, for example. The multiple layers may be identical to each other but for their size and orientation, with each adjacent inner layer being slightly smaller then its adjacent outer layer and orientated so as to improve strength and uniformity in performance. Different layers may be manufactured from different materials so as to further still refine the ball's attributes. An exemplary embodiment of a multiple layer ball design comprises a covering layer, an intermediate layer and an inner bladder, such that the covering layer and the intermediate layer offset the structural weakness in each other making the performance of the entire ball more uniform. More additional layers may be used to further improve the ball's strength and uniformity in performance. A solid ball may be produced when enough layers are used, with the innermost layer forming the ball's core. Moreover, ball cover designs that are aesthetically interesting and unique and have a recreational or celebratory appeal also may be produced with the use of exotic or irregular panel geometries of the ball surface.

As previously noted, the preferred embodiments of ball designs according to the present invention disclosed herein are based on two classes of doubly-curved edges, Class 1 and Class 2, for panels forming a multi-panel sports ball having identical panels. Each panel in both classes is a p-sided polygon with p number of curved edges bound by p number of vertices. Various exemplary panels for each class are shown in FIGS. 1 and 2.

In the first class, Class 1, each edge is either a concave or convex curve, i.e. it is either curving inwards or outwards from the center of the polygonal panel. A practical design resulting from this is to alternate the curvatures of edges of source polygons, so one edge is convex and the next adjacent edge is concave, and so on in an alternating manner. This method of alternating edges works well when source polygons are even-sided. This way the overall symmetry of the polyhedron, and hence the ball design, is retained. This symmetry-retention is important for the dynamics of the ball so it has even motion. In each instance, the alternating edges of the flat polygon of the polyhedron are curved inwards and outwards. This retains the 2-fold symmetry of the polygon.

In ball designs with Class 2 edges, each edge undulates in a wave-like manner. It has a convex curvature in one half of the edge and a concave curvature in the other half. A practical design using undulating edges is to arrange these edges in a rotary manner around each vertex of the source polyhedron. This method enables the ball to retain the original symmetry of the source polyhedron. The symmetry provides for evenness of the ball in flight, similarly to the designs with Class 1 edges.

Figure 2:
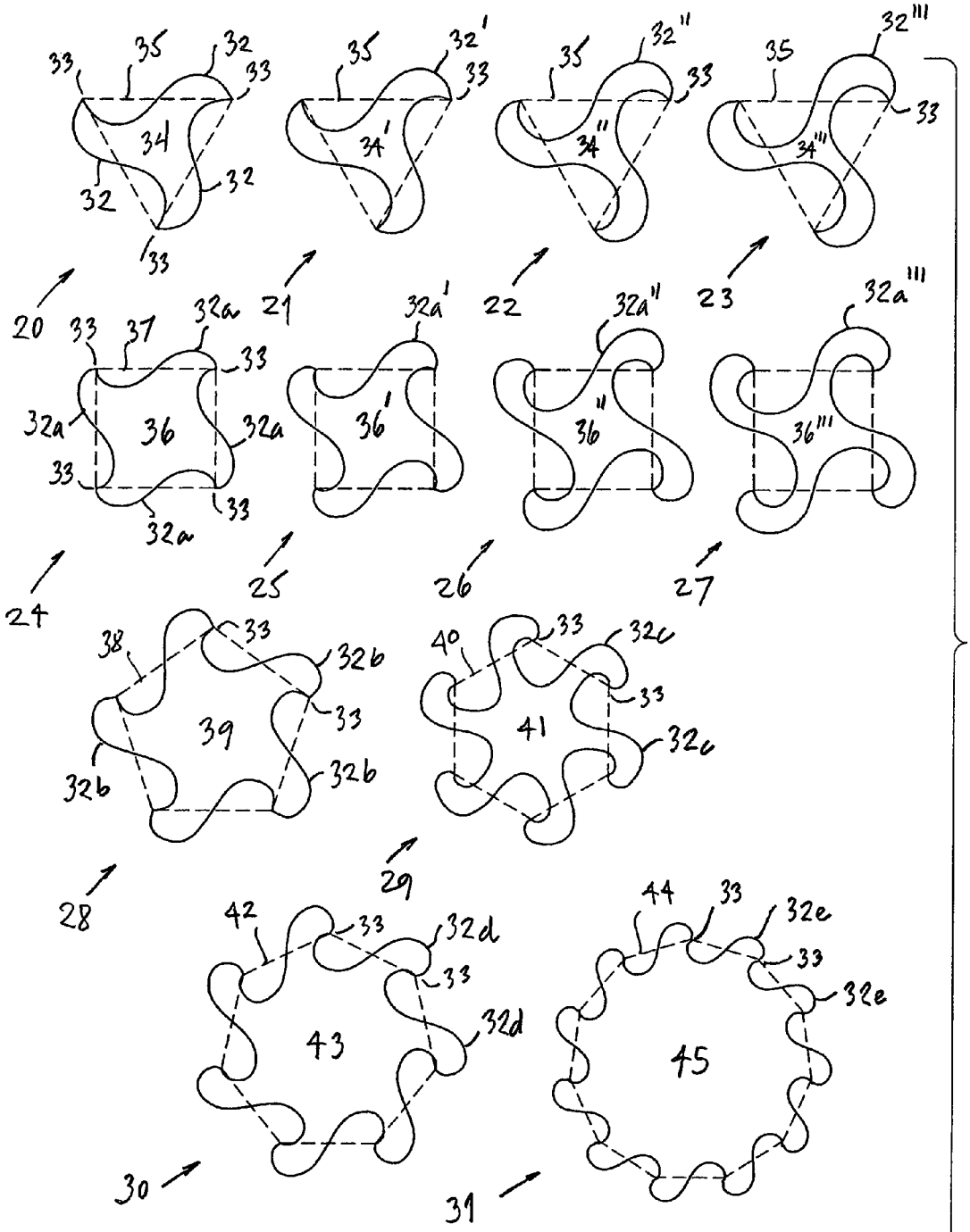
FIG. 2 shows variations in edge curvatures of Class 2 for p-sided polygonal panels having p=3, 4, 5, 6, 7 and 11.

FIG. 1 shows design embodiments having edges of Class 1 and its variants for different 4-sided polygons (p=4 cases). Each edge is an asymmetric curve, like a tilted arch and has no symmetry. Panel design views 1 to 4 show a sequence of panel designs based on the source square 17, panel design views 5 to 8 show a sequence of panel designs based on the source rhombus 17*a*, and panel design views 9 to 12 show a sequence of panel shapes based on the source trapezoid 17*b*. The curved edges on all four sides of the panel are identical in the case of square-based and rhombus-based panels, and in the trapezoid-based panels, the curves have different sizes.

Panel design view 1 shows the 4-sided panel 16 bound by four curved edges 13 and two pairs of alternating vertices 14 and 15. The edges alternate in and out in a cyclic manner such that a convex edge is followed by a concave edge as we move from edge to edge in a clockwise or counter-clockwise manner. Panel design views 2 to 4 show how the panel shapes can be altered by changing the edge curve to 13', 13" or 13'", respectively. In doing so, the middle region of the panel thins out and the polygonal panel shape begins to become more uniformly slender as it changes to 16', 16" and 16'", respectively. These edges can be controlled in a computer model so the shape of the panel can be made most uniformly slender.

The description for panel design views 5 to 8 and 9 to 12 is the same as the description above for views 1 to 4 with same parts numbers except for the panel and source polygons, which have suffixes 'a' and 'b' corresponding to views 5 to 8 and 9 to 12, respectively. Note that the trapezoid-based 9 has two types of edges, 13*b* and 13*b*1, and four different vertices, 14, 15, 14*a* and 15*b*.

FIG. 2 shows design embodiments having edges of Class 2 and its variants for different polygonal panels. Each edge is a smooth wave curve with a concave region on one half of the edge and an equivalent convex region on the other half. Each p-sided polygon has p number of edges bound by p number of vertices and the edges are configured to retain the p-fold symmetry of the polygon. Panel design views 20 to 23 show a sequence of 3-sided (p=3) panel designs, panel design views 24 to 27 show a sequence of 4-sided (p=4) panel designs, panel design view 28 shows an example of a p=5 panel design, and panel design views 29 to 31 show examples of panel designs with p=6, 7 and 11, respectively.

Panel design view 20 shows a 3-sided panel 34 bound by three undulating edges 32 and three vertices 33, based on the source triangle 35. The edges are arranged around the center of the panel in a rotationally symmetric manner so as to retain the 3-fold symmetry of the triangle. Panel design views 21 to 23 show variations by changing the edge curves to 32', 32" and 32'", respectively, with a corresponding change in the panel shape to 34', 34" and 34'". Here too, the edges can be controlled in a computer model so as to make the panel as uniformly wide throughout as possible.

Panel design view 24 shows a 4-sided panel 36 bound by four undulating edges 32*a* and four vertices 33, based on the source square 37. The edges are arranged around the center of the panel in a rotationally symmetric manner so as to retain the 4-fold symmetry of the square. Panel design views 25 to 27 show variations by changing the edge curves to 32*a*', 32*a*" and 32*a*'", respectively, with a corresponding change in the panel shape to 36', 36" and 36'". Here too, the edges can be controlled in a computer model so as to make the panel as uniformly wide throughout as possible.

Panel design view 28 shows a 5-sided panel 39 bound by five undulating edges 32*b* and five vertices 33, based on the source pentagon 38. The edges are arranged around the center of the panel in a rotationally symmetric manner so as to retain the 5-fold symmetry of the pentagon.

Panel design view 29 shows a 6-sided panel 41 bound by six undulating edges 32*c* and six vertices 33, based on the source hexagon 40. The edges are arranged around the center of the panel in a rotationally symmetric manner so as to retain the 6-fold symmetry of the hexagon.

Panel design view 30 shows a 7-sided panel 43 bound by seven undulating edges 32*d* and seven vertices 33, based on the source heptagon 42. The edges are arranged around the center of the panel in a rotationally symmetric manner so as to retain the 7-fold symmetry of the heptagon.

Panel design view 31 shows an 11-sided panel 45 bound by eleven undulating edges 32*e* and eleven vertices 33, based on the source undecagon 44. The edges are arranged around the center of the panel in a rotationally symmetric manner so as to retain the 11-fold symmetry of the undecagon.

Figure 4:
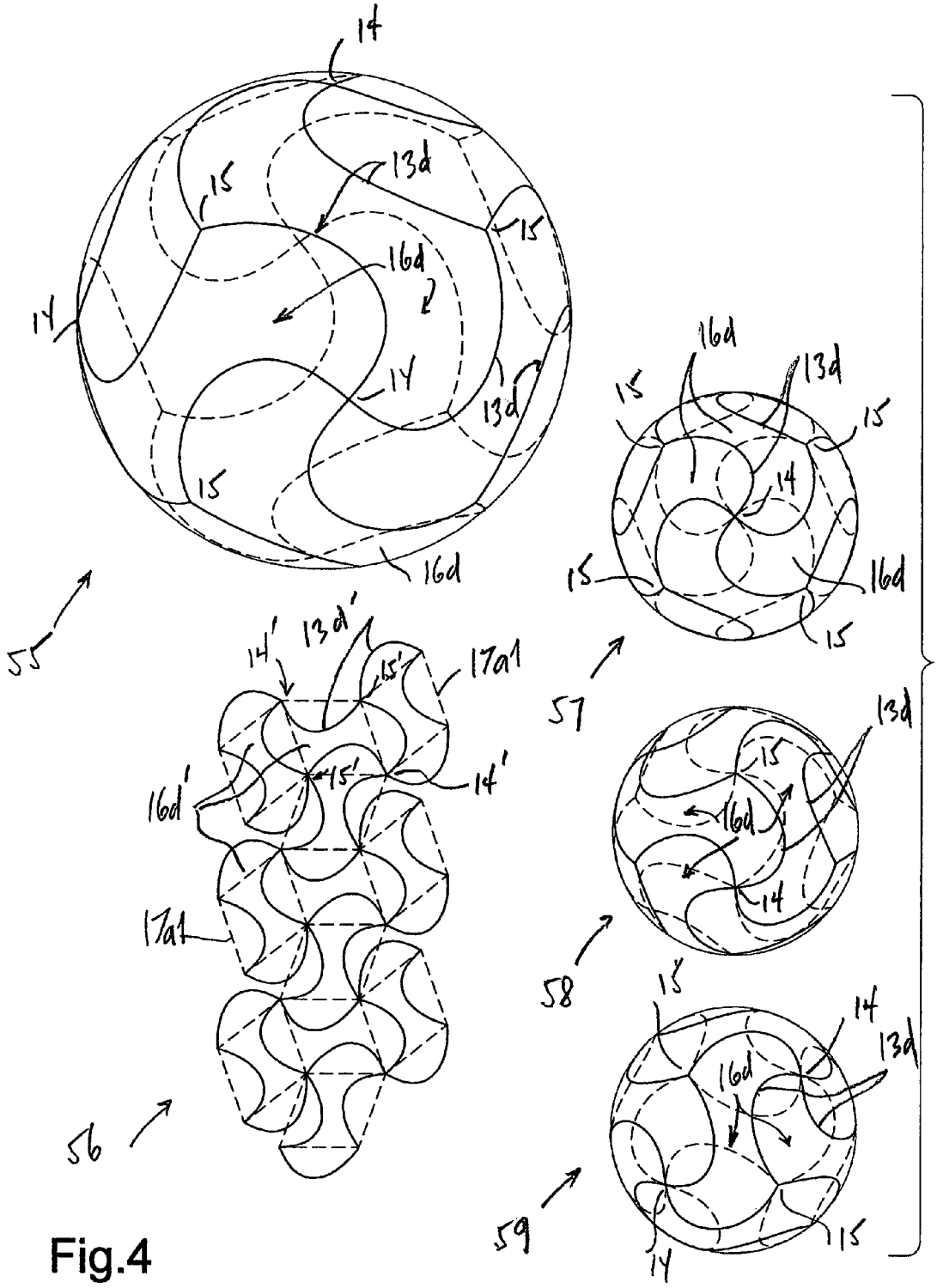
FIG. 4 shows a 12-panel ball, based on the rhombic dodecahedron, having identical 4-sided (p=4) polygonal panels, each panel having curved edges of Class 1.
Figure 5:
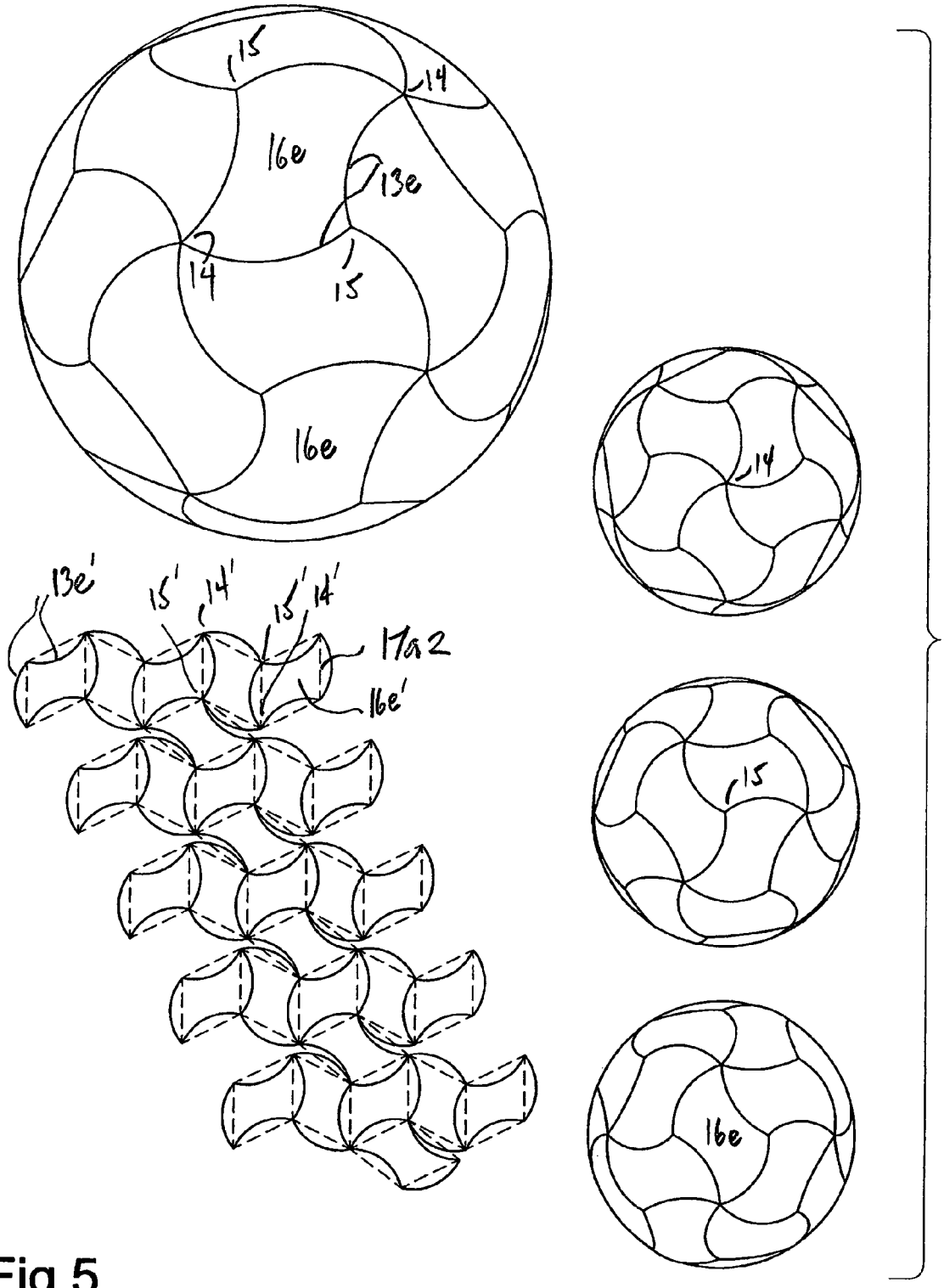
FIG. 5 shows a 30-panel ball, based on the rhombic triacontahedron, having identical 4-sided (p=4) polygonal panels, each panel having curved edges of Class 1.
Figure 6:
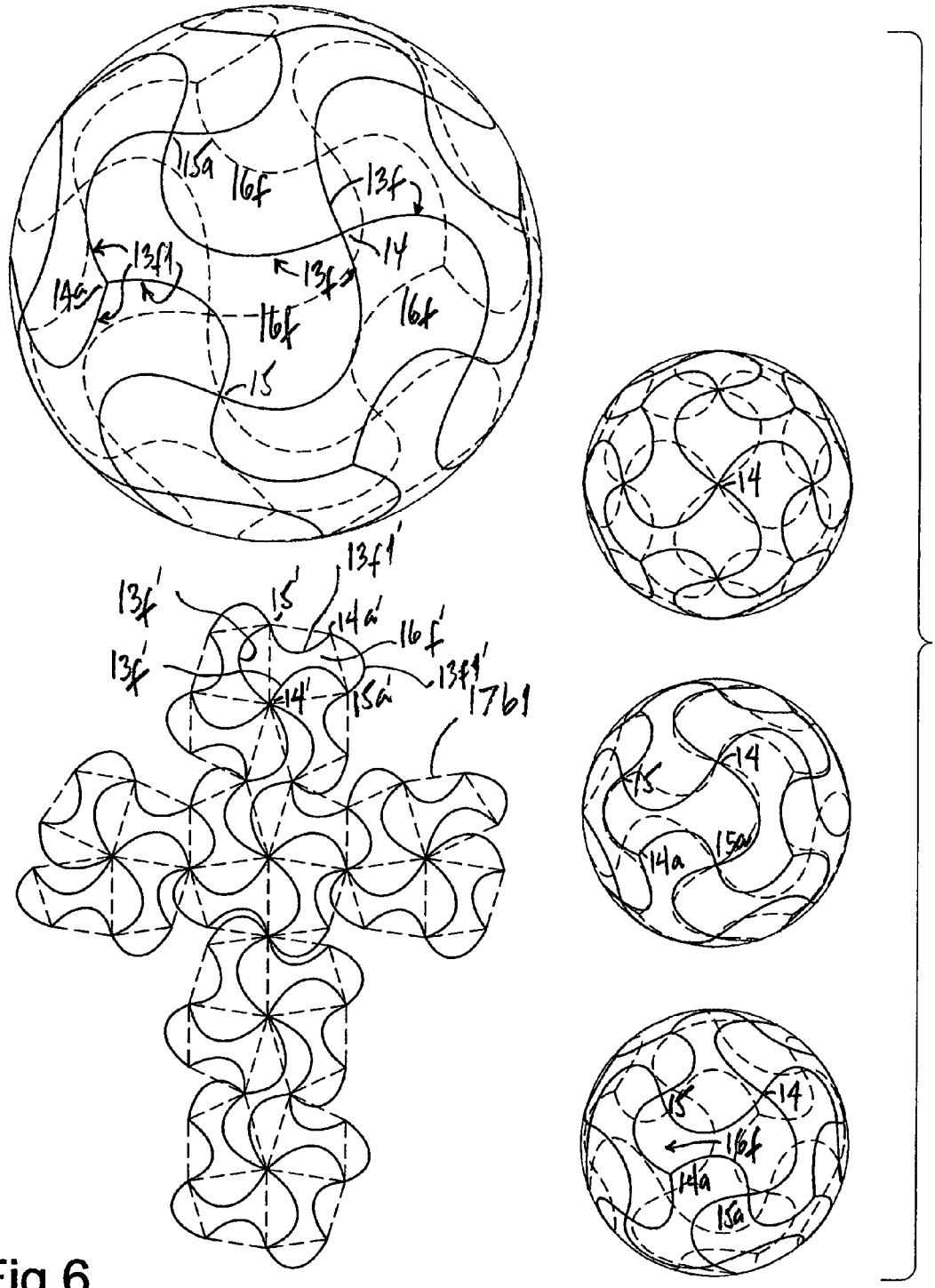
FIG. 6 shows a 24-panel ball, based on the trapezoidal icositetrahedron, having identical 4-sided (p=4) polygonal panels having edges of Class 1.
Figure 7:
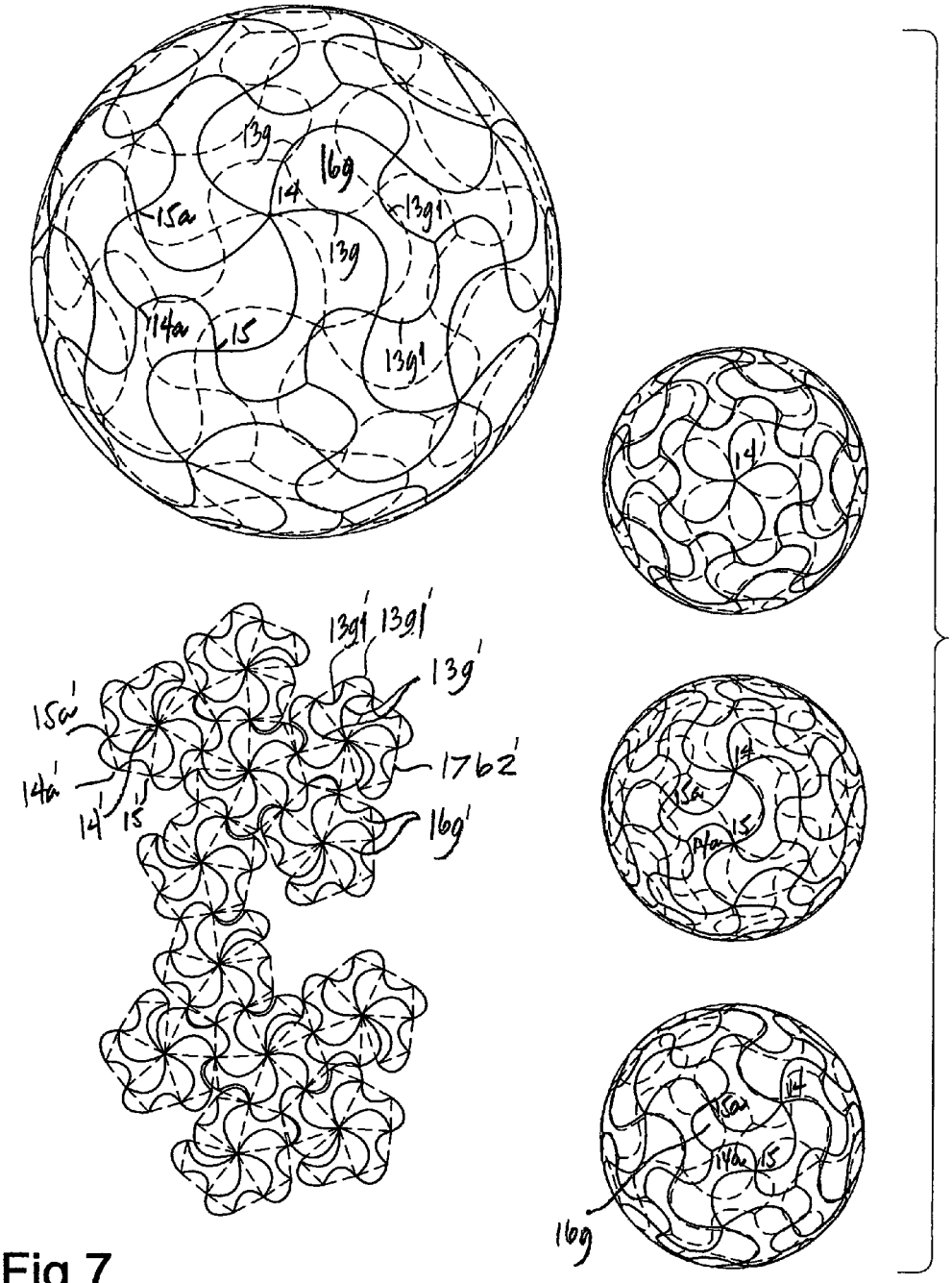
FIG. 7 shows a 60-panel ball, based on the trapezoidal hexecontahedron, having identical 4-sided (p=4) polygonal panels having edges of Class 1.

FIGS. 3 to 7 show embodiments of the present invention as ball designs with Class 1 edges. An easy way to visualize the curvature of edges for the two classes is to look at how these edges are distributed in the imagined flattened nets of source polyhedra. Imagined flattened nets are well-known in the art and are commonly used for building models of source polyhedra from sheet material like paper, metal, etc. All imagined flattened nets shown herein are schematic and do not show a literal flattening of a curved panel since such a literal flattening would produce tears or wrinkles in the panels. The source polyhedra for the designs shown here with Class 1 edges are polyhedra having identical 4-sided polygons. These include the cube (FIG. 3), two Archimedean duals having identical rhombuses (FIGS. 4 and 5), and two other Archimedean duals having identical kite-shaped polygons (FIGS. 6 and 7).

Figure 3:
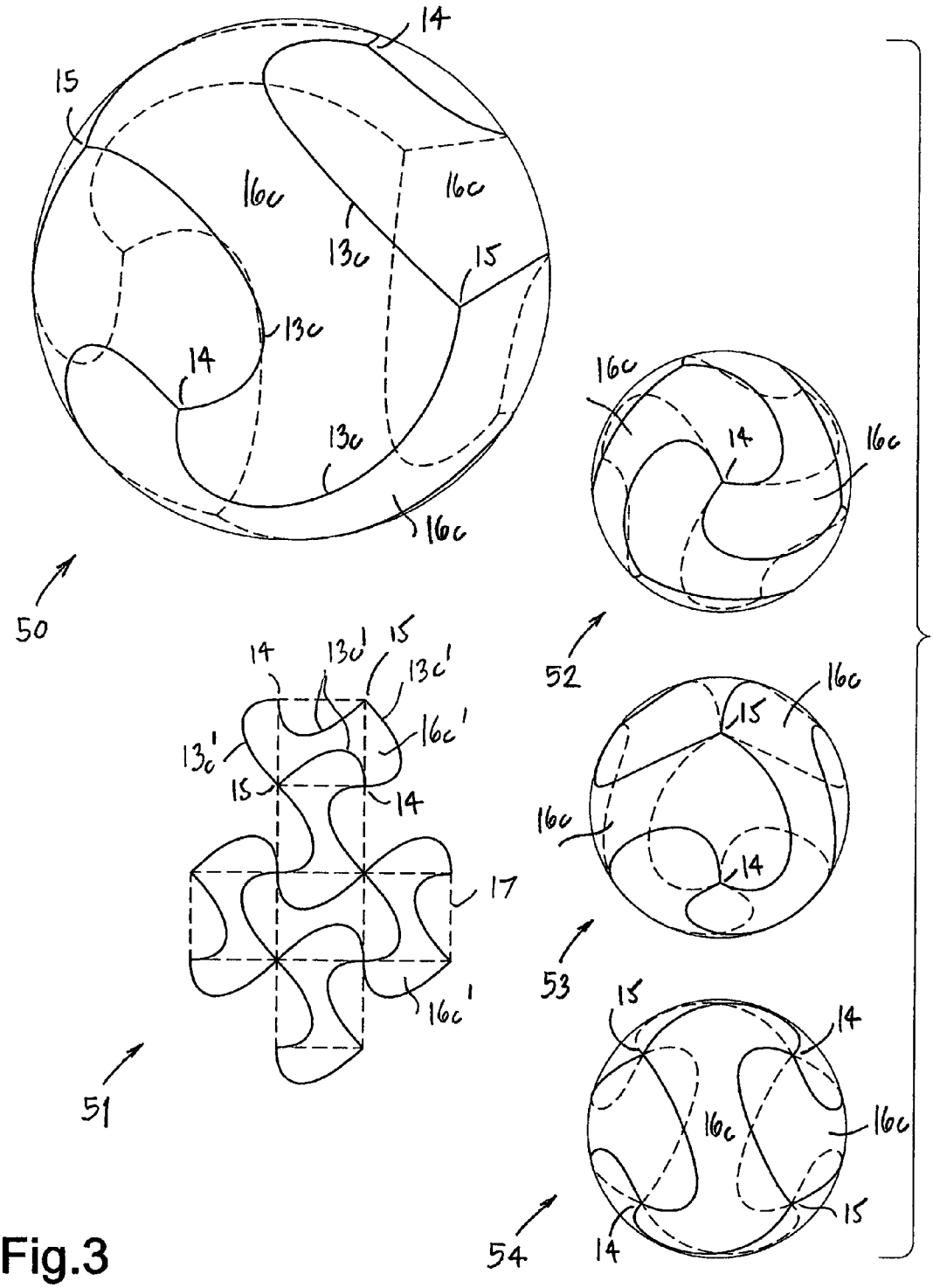
FIG. 3 shows a 6-panel ball, based on the cube, having six identical 4-sided (p=4) polygonal panels having curved edges of Class 1.

FIG. 3 shows a 6-panel ball 50, based on the source cube, having six identical 4-sided (p=4) polygonal panels 16*c* having twelve curved edges 13*c* of Class 1 meeting at alternating vertices 14 and 15. The ball has eight vertices, with four of each alternating with the other. The imagined flattened net 51 shows the corresponding flat panels 16*c*' having corresponding flat curved edges 13*c*' arranged cyclically around corresponding vertices 14' and 15' which alternate around source squares 17 of the imagined flattened net. In this flattened state, it is clear that the edge curves are asymmetric but are arranged alternately around source squares 17 in a 2-fold rotational symmetry. The asymmetry of each edge and the 2-fold rotational symmetry of each panel is retained in the spherical ball 50. This 2-fold symmetry of the spherical panel is clear from view 54. The ball is shown in two additional views, view 52 along vertex 14, and view 53 along the two vertices 14 and 15.

FIG. 4 shows a 12-panel ball 55, based on the rhombic dodecahedron, having identical 4-sided polygonal panels 16*d* (p=4), which meet at a total of 24 curved edges 13*d* of Class 1 and alternating vertices 14 and 15. Each panel has the curved edges arranged in a 2-fold symmetry around the center of the panel. The imagined flattened net 56 shows an imagined flattened pattern of the 12 panels where each imagined flattened panel 16*d*', bound by flattened edges 13*d*', is based on a rhombus 17*a*1 having diagonals in ratio of 1 and square root of 2. Of the two types of vertices of the ball design, eight vertices 15 have three edges meeting at them and the remaining six vertices 14 have four edges meeting at them. Views 57 to 59 show different views of the ball according to this design embodiment.

FIG. 5 shows a 30-panel ball, based on the rhombic triacontahedron, having identical 4-sided panels, 60 curved edges of Class 1 and 32 vertices. Each panel has its curved edges arranged in a 2-fold symmetry around the center of the panel. The flattened pattern shows how the panels relate to the source rhombuses and to one another. Each source rhombus has its diagonals in a "golden ratio" (i.e. (1+sqrt(5))/2). This ball design also has two types of vertices, twelve of vertices 14 where five edges meet and twenty of vertices 15 where three edges meet.

FIG. 6 shows a 24-panel ball, based on the trapezoidal icositetrahedron, having identical 4-sided panels. Each panel, based on a source trapezoid 17*b*1, has 4 different curved edges, two each of 13*f* and 13*f*1, arranged with no symmetry in the panel. It has four different types of vertices 14, 15, 14*a* and 15*a*. The imagined flattened net shows a layout pattern of the panels in an imagined flattened state.

FIG. 7 shows a 60-panel ball, based on the trapezoidal hexacontahedron, having identical 4-sided panels. Each panel, based on a source trapezoid 17*b*2, has 4 different curved edges, two each of 13*g* and 13*g*1, arranged with no symmetry in the panel. It has four different types of vertices 14, 15, 14*a* and 15*a*. The imagined flattened net shows a layout pattern of the panels in an imagined flattened state.

Figure 8:
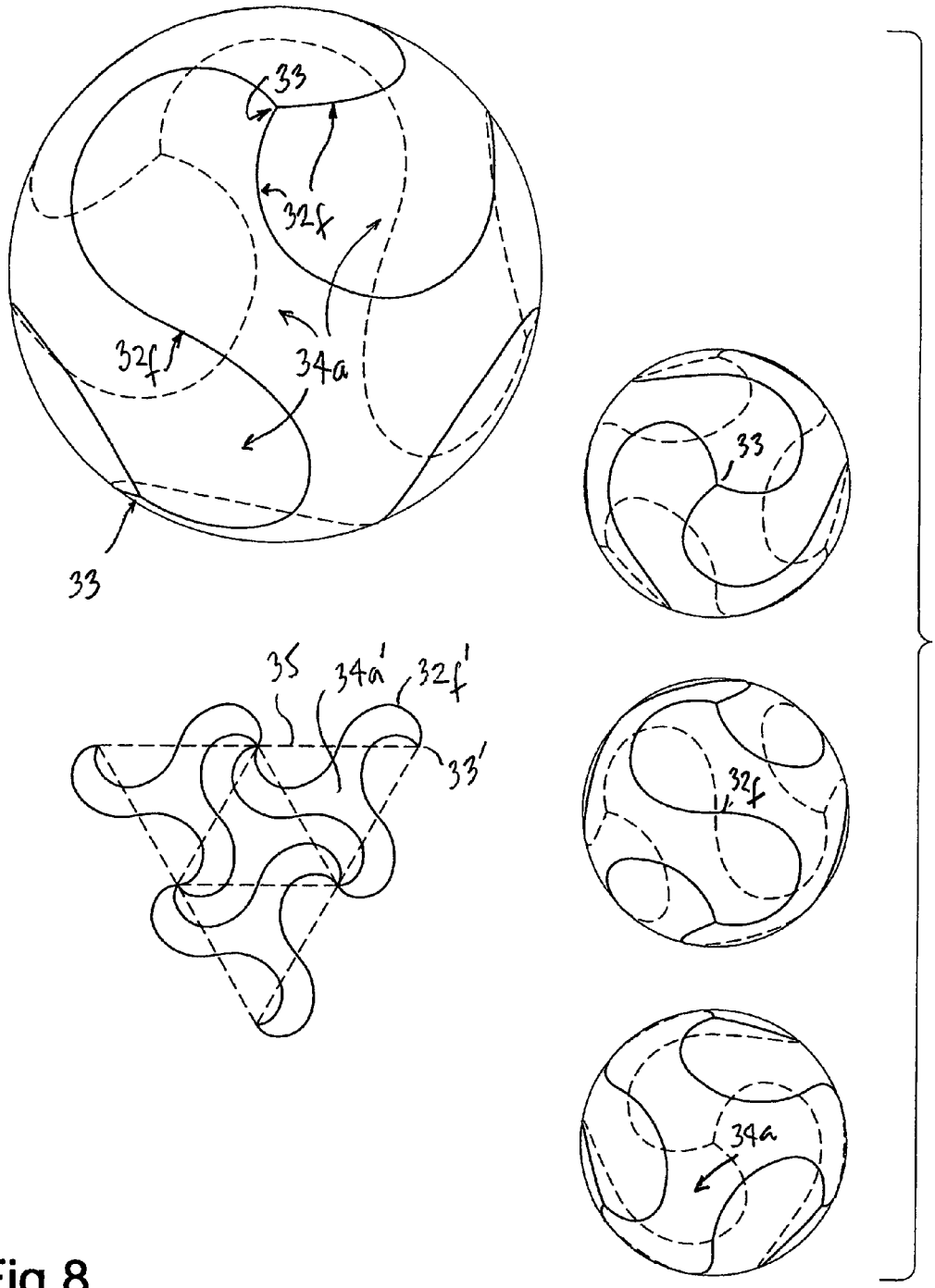
FIG. 8 shows a 4-panel ball, based on the regular tetrahedron, having identical 3-sided (p=3) panels having edges of Class 2.

FIGS. 8 to 12 show five design embodiments with Class 2 edges based on regular polyhedra. FIG. 8 shows a 4-panel ball, based on the regular tetrahedron, having identical 3-sided (p=3) panels 34*a* bound by six identical edges 32*f* of Class 2 and four identical vertices 33.

Figure 9:
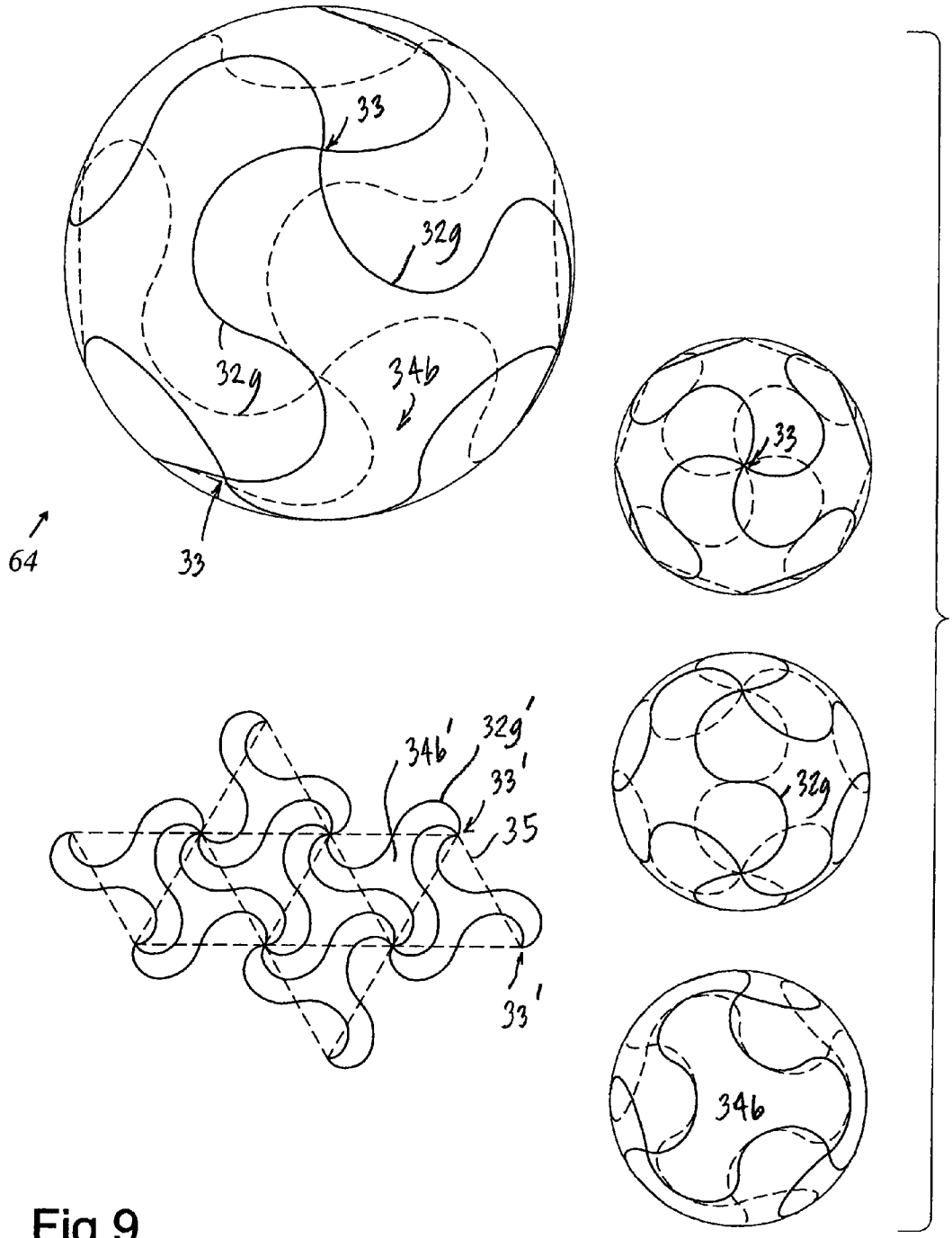
FIG. 9 shows an 8-panel ball, based on the regular octahedron, having identical 3-sided (p=3) panels having edges of Class 2.

FIG. 9 shows an 8-panel ball 64, based on the regular octahedron, having identical 3-sided (p=3) panels 34*b* bound by twelve identical edges 32*g* of Class 2 and six identical vertices 33.

Figure 10:
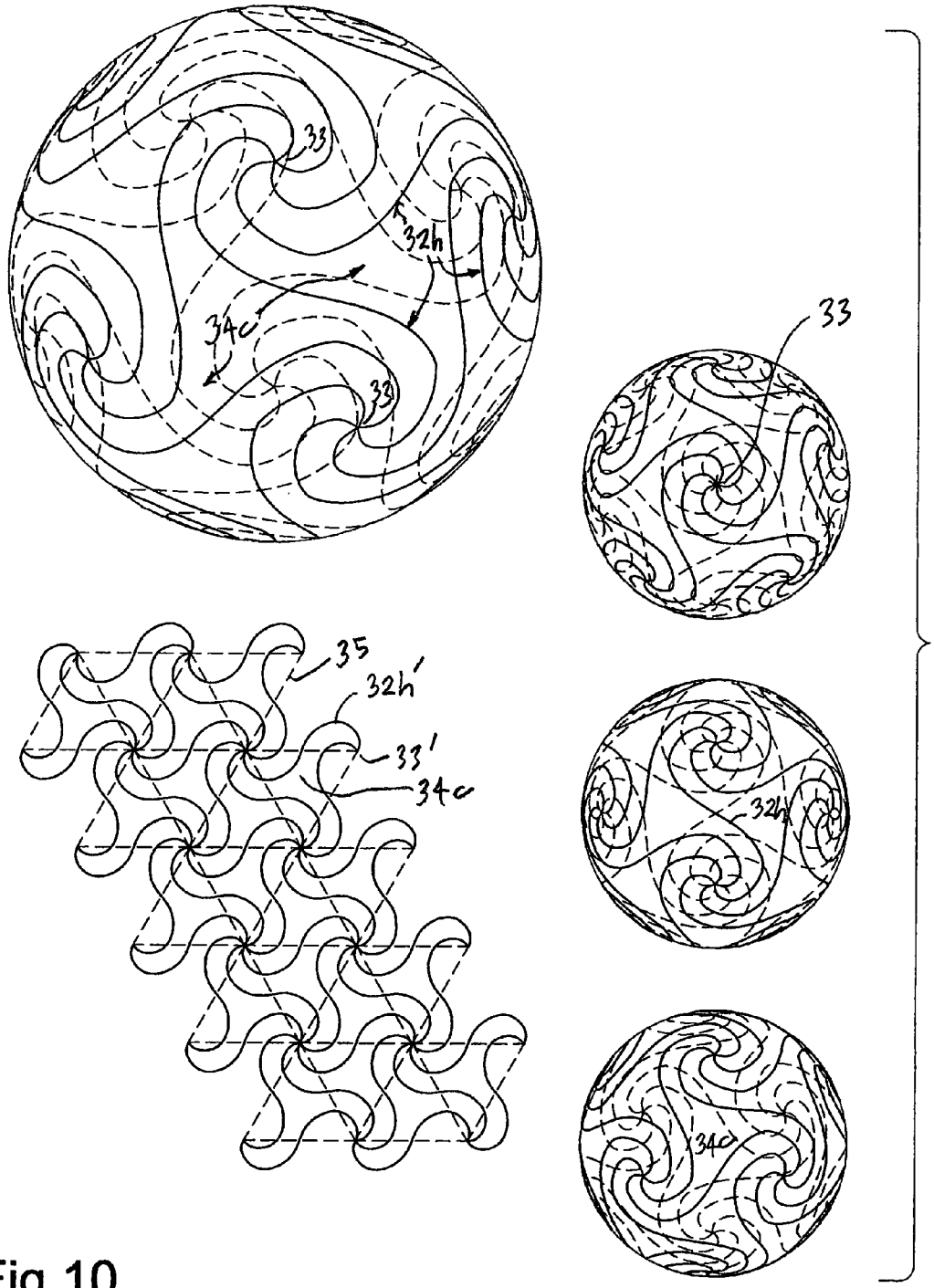
FIG. 10 shows a 20-panel ball, based on the regular icosahedron, having identical 3-sided (p=3) panels having edges of Class 2.

FIG. 10 shows a 20-panel ball, based on the regular icosahedron, having identical 3-sided (p=3) panels 34*c* bound by thirty identical edges 32*h* of Class 2 and twelve identical vertices 33.

Figure 11:
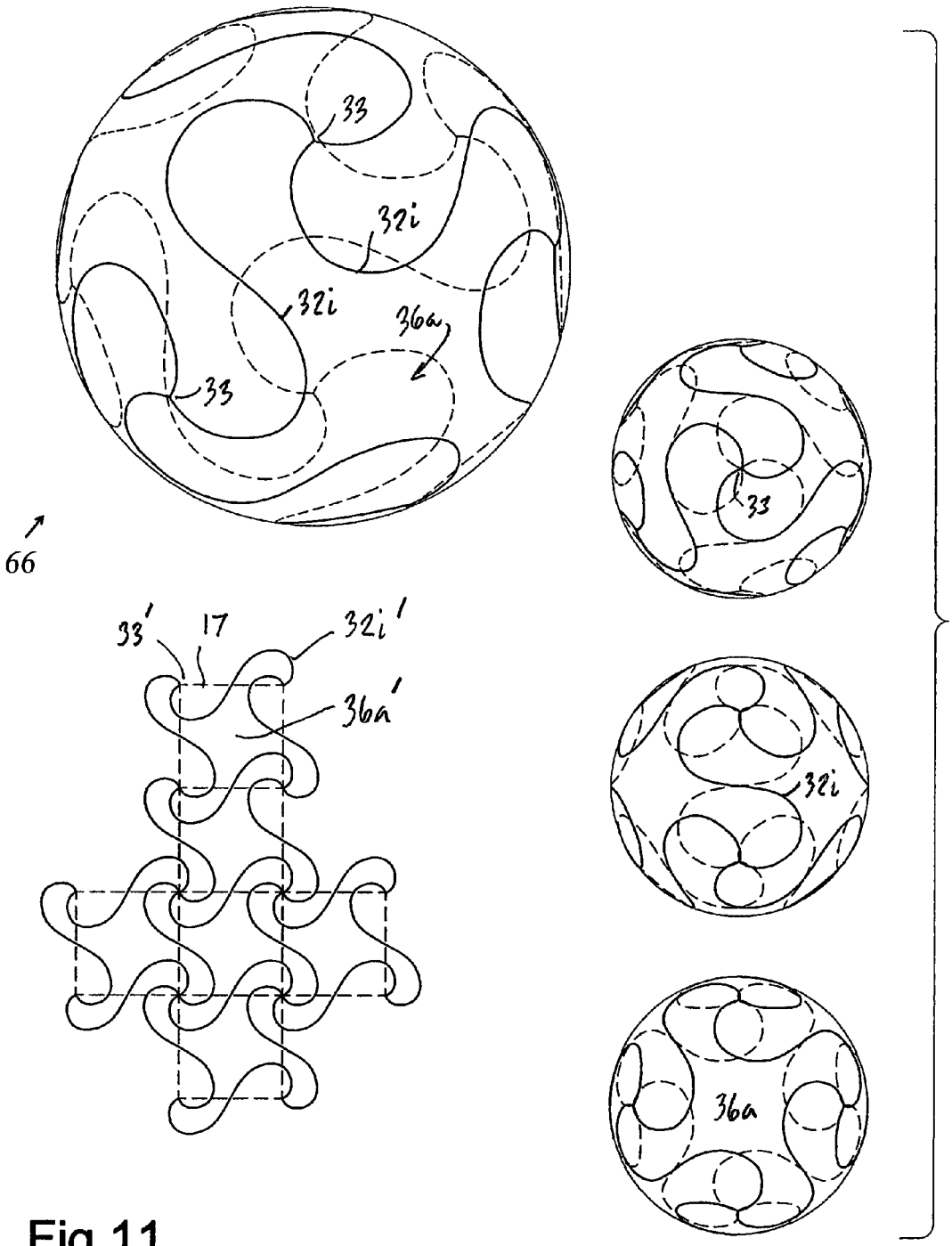
FIG. 11 shows a 6-panel ball, based on the cube, having identical 4-sided (p=4) panels having edges of Class 2.

FIG. 11 shows a 6-panel ball 66, based on the regular cube, having identical 4-sided (p=4) panels 36*a* bound by twelve identical edges 32*i* of Class 2 and eight identical vertices 33.

Figure 12:
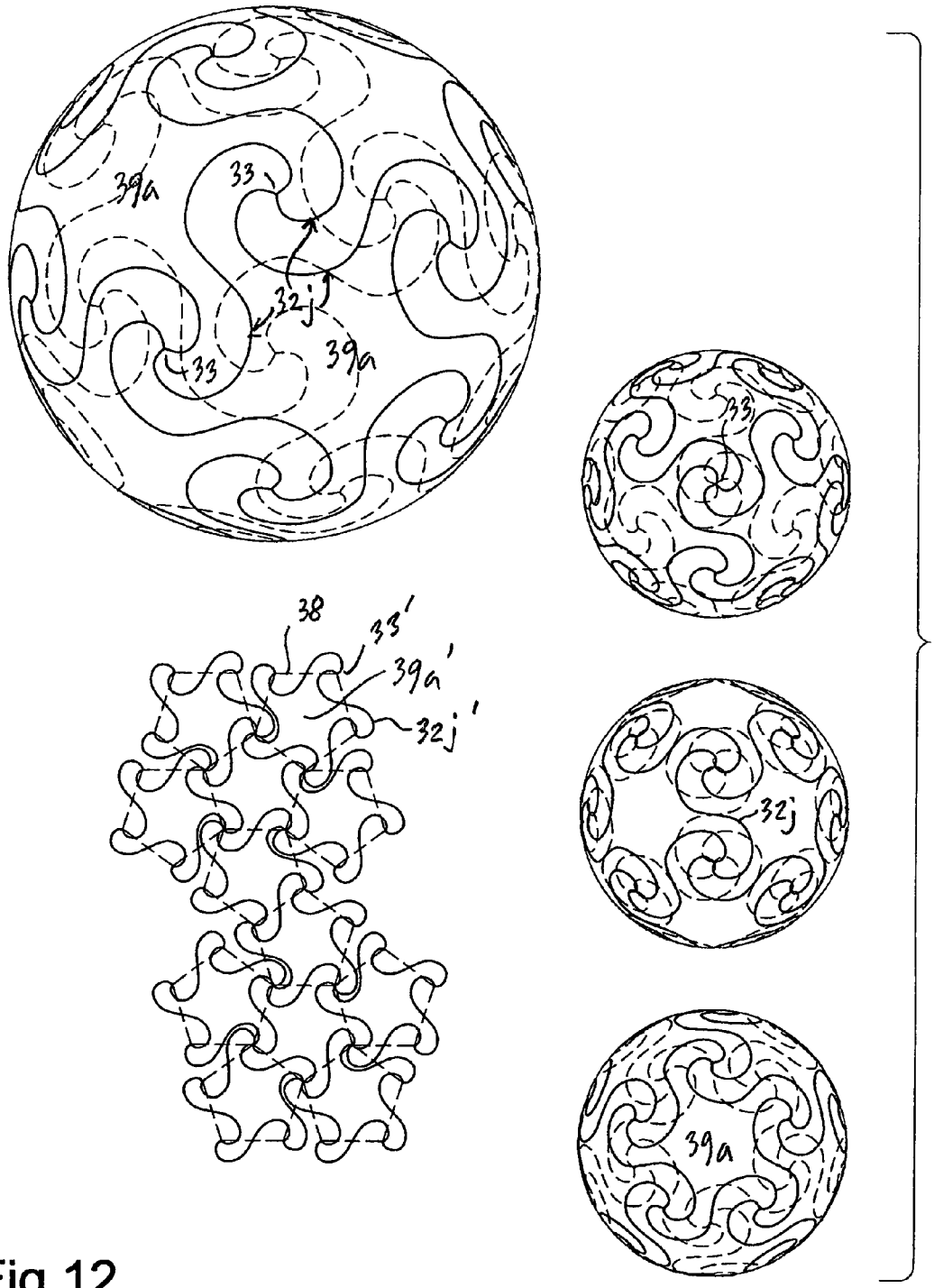
FIG. 12 shows a 12-panel ball, based on the regular dodecahedron, having identical 5-sided (p=5) panels having edges of Class 2.

FIG. 12 shows a 12-panel ball, based on the regular pentagonal dodecahedron, having identical 5-sided (p=5) panels 39*a* bound by identical edges 32*j* of Class 2 and twenty identical vertices 33.

Figure 13:
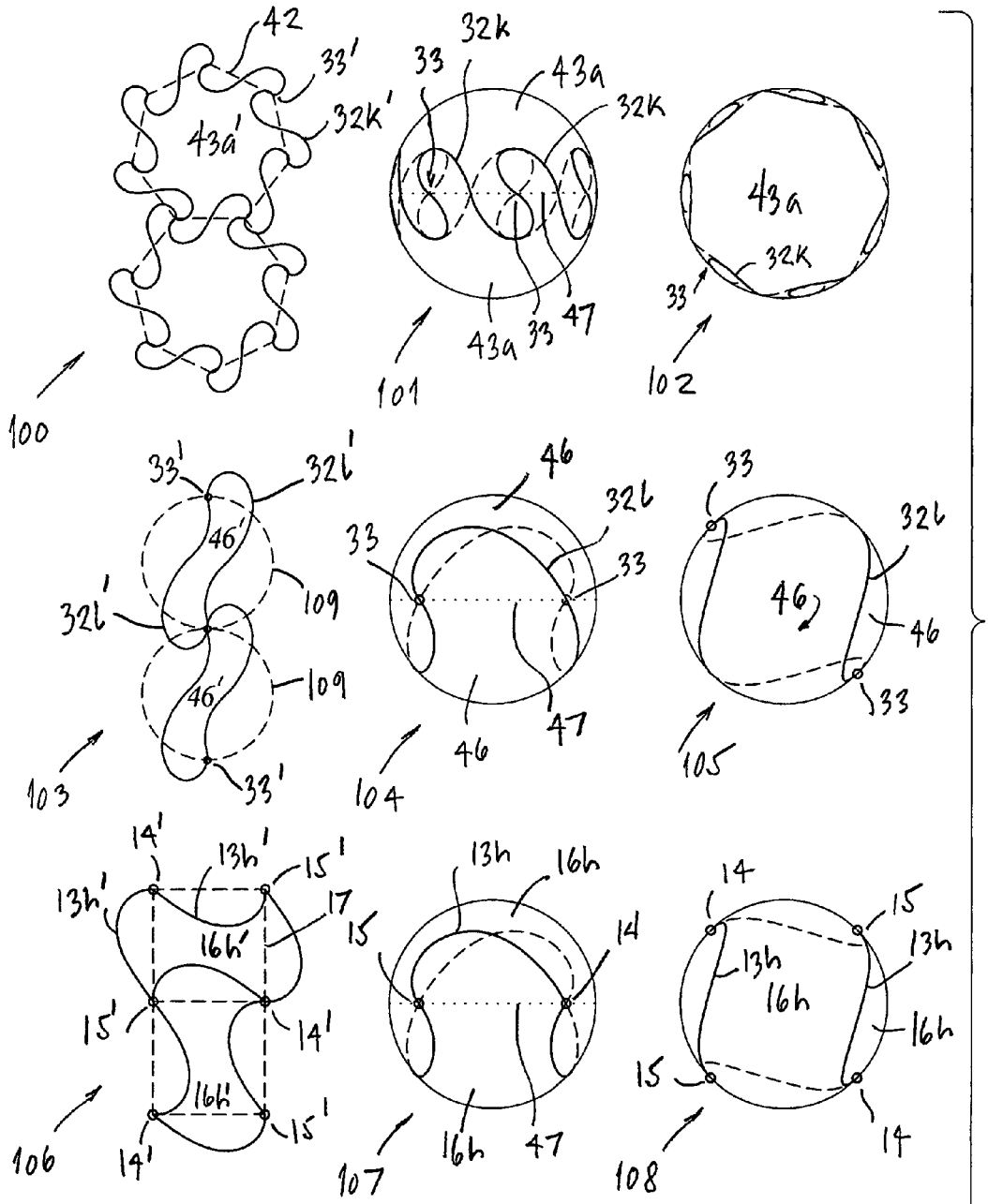
FIG. 13 shows three different designs for a 2-panel ball, based on a 7-sided (p=7) dihedron having edges of Class 2, a 2-sided (p=2) dihedron having Class 2 edges, and another 4-sided (p=4) dihedron having Class 1 edges.

FIG. 13 shows three different ball design embodiments based on dihedral polyhedra, each having two identical panels with different number of sides and edges of Class 1 or Class 2.

The top illustration of FIG. 13 shows a ball 101 in a side view having two identical 7-sided panels 43*a* (p=7) bound by seven edges 32*k* of Class 2 and seven identical vertices 33 lying on an imaginary equator 47. The imaginary equator 47 is used herein to show where vertices 33 are located on ball 101 because vertices 33 are embedded in a curved continuous edge formed by the seven edges 32*k*. The location of vertices 33 on ball 101 can be deduced by imagining the imaginary equator 47. The imagined flattened net 100 shows the two 7-sided panels 43*a*' bound by edges 32*k*' and vertices 33' defined by the source heptagon 42. View 102 shows a plan view.

The middle illustration of FIG. 13 shows a ball 104 in a side view having two identical 2-sided (p=2) panels 46 bound by two identical edges 321 and two identical vertices 33 lying on the imaginary equator 47. The imaginary equator 47 is used herein to show where vertices 33 are located on ball 104 because vertices 33 are embedded in a curved continuous edge formed by the two edges 321. The location of vertices 33 on ball 104 can be deduced by imagining the imaginary equator 47. The imagined flattened net 103 shows the two 2-sided panels 46' bound by edges 321' and vertices 33', and the two source digons 109. The imagined flattened net 103 also shows how the two side edges are unparallel to each other so as to form a neck region and two outer lobe regions, the two side edges being spaced closer to each other in the neck region than in the outer lobe regions. View 105 is the plan view.

The bottom illustration of FIG. 13 shows a ball 107 in a side view having two identical 4-sided (p=4) panels 16*h* bound by four identical edges 13*h* of Class 1 and four vertices comprising two pairs of alternating vertices 14 and 15 lying on the imaginary equator 47. The imagined flattened net 106 shows the two 4-sided panels 16*h*' bound by edges 13*h*' and alternating vertices 14' and 15', and the two source squares 17. View 108 is the plan view.

Figure 14:
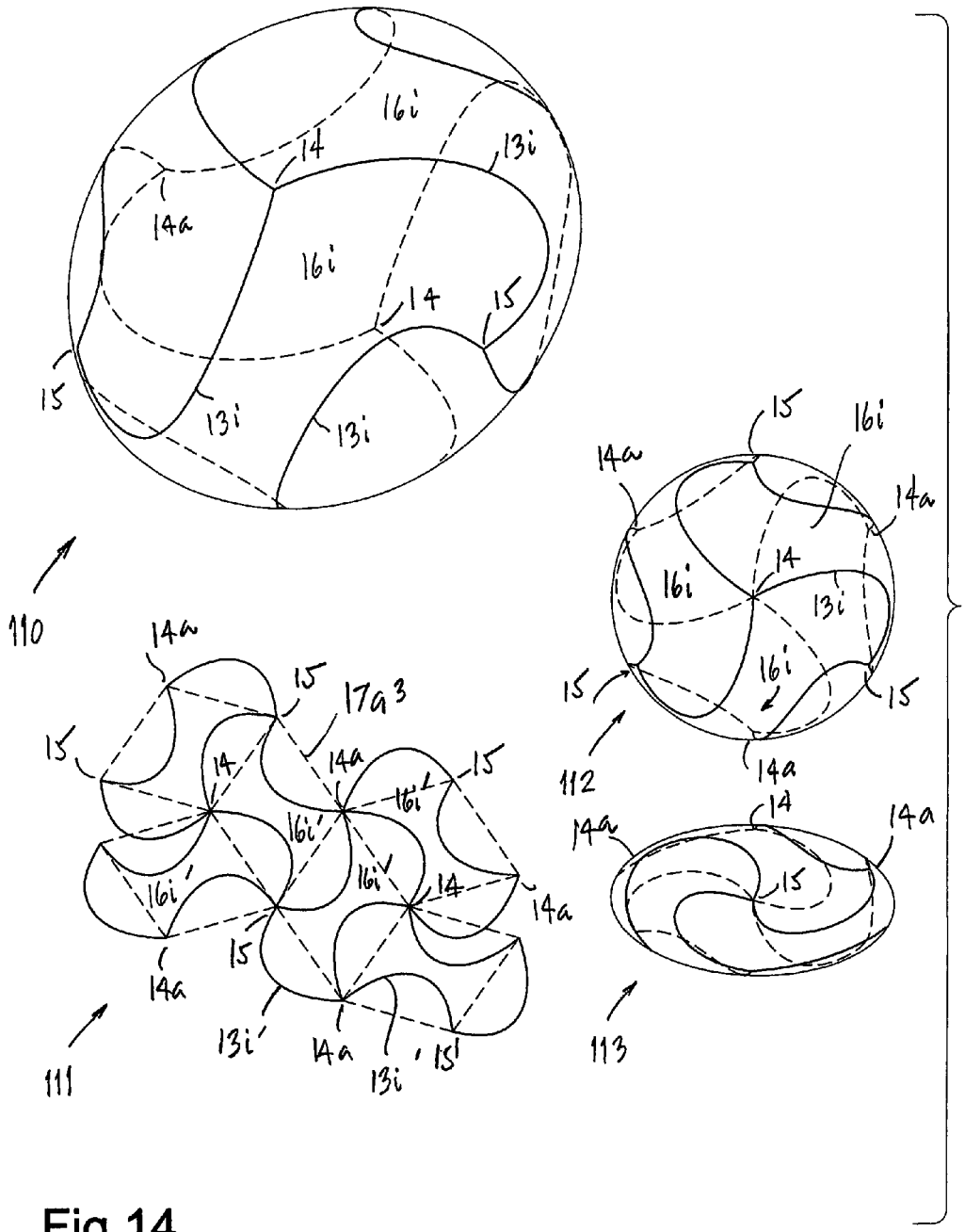
FIG. 14 shows an oblate ellipsoidal ball, based on a rhombohedron, having 4-sided (p=4) panels having edges of Class 1. It is topologically isomorphic to the ball shown in FIG. 3.
Figure 15:
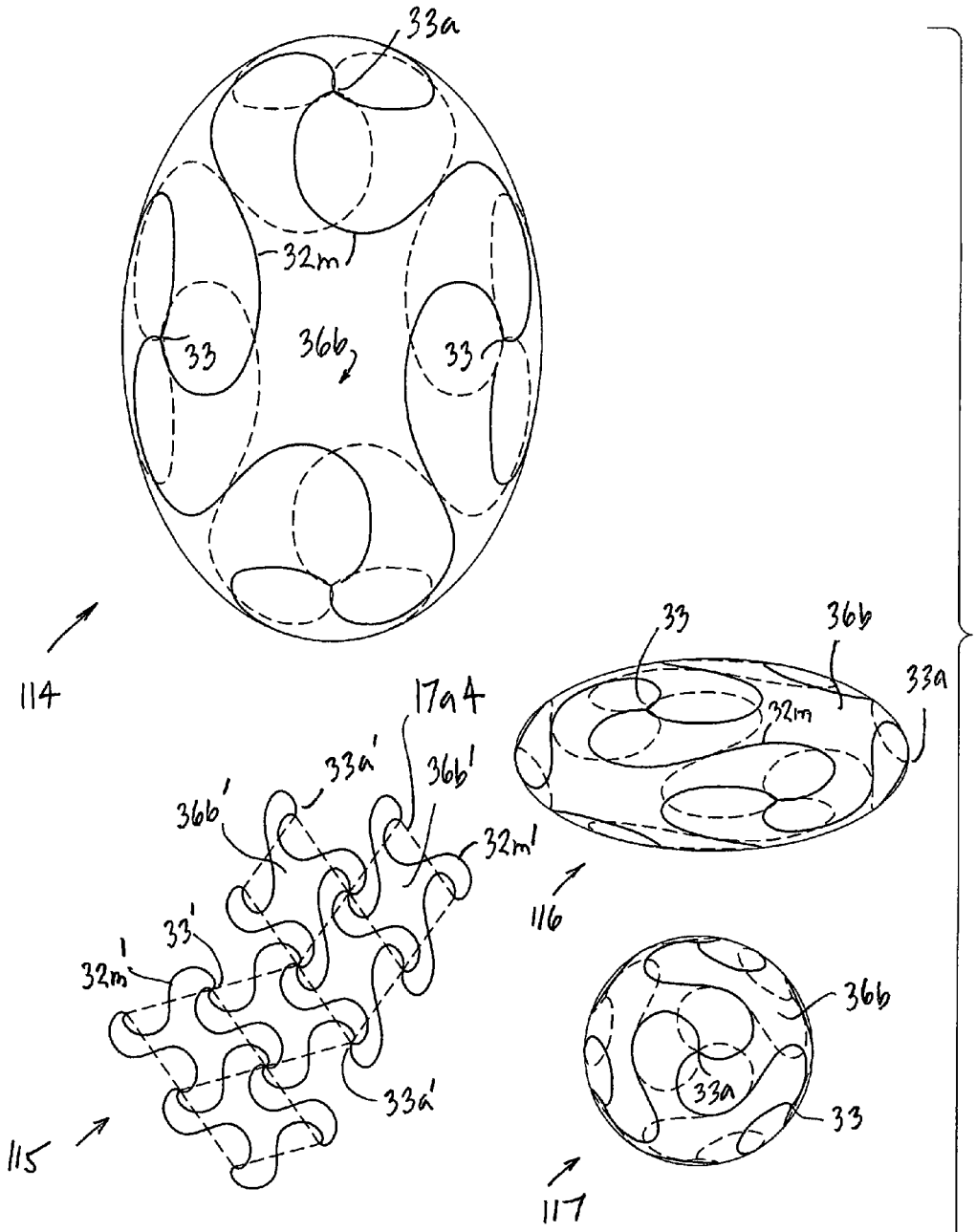
FIG. 15 shows an elongated ellipsoidal ball design, based on a rhombohedron, having 4-sided (p=4) panels having edges of Class 2. It is topologically isomorphic to the ball shown in FIG. 11.

FIGS. 14 and 15 show two embodiments of the present invention as ellipsoidal variants of the ball designs previously disclosed herein. FIG. 14 shows a 6-panel oblate ellipsoidal ball 110 with twelve Class 1 edges 13*i*, six 4-sided (p=4) panels 16*i* and eight vertices. The vertices are of three kinds, two of vertex 14 on opposite polar ends, surrounded by three each of vertices 15 and 14*a* which alternate with one another. It is based on an oblate rhombohedron and is a squished version of the ball 50 shown in FIG. 3. Imagined flattened net 111 is the imagined flattened net with corresponding panels 16*i*', edges 13*i*', and vertices 14', 15' and 14*a*'. The flattened panels are based on the rhombus 17*a*3. Views 112 and 113 show two different views of the ball, the former centers around vertex 14 and the latter around vertex 15.

FIG. 15 shows a 6-panel elongated ellipsoidal ball 114 with twelve Class 2 edges 32*m*, six 4-sided (p=4) panels 36*b* bound by eight vertices. Two of these vertices, 33*a*, lie on the polar ends of the ellipsoid, and the remaining six vertices 33 surround these two. Ball 114 is an elongated version of the ball shown in FIG. 11. The imagined flattened net shows the corresponding panels 36*b*' bound by edges 32*m*' and vertices 33*a*' and 33' based on the source rhombus 17*a*4. Views 116 and 117 show two different views of the ball, the former around the edge 32*m* and the latter around vertex 33*a*.

FIGS. 16 to 22 show examples of multi-layer ball designs according to the present invention having at least two layers in addition to the innermost layer like a bladder or a core. A unique feature of these embodiments is that the two layers are topological duals of one another, with the vertices in one layer reciprocating with the faces in the other layer, and vice versa. The vertices preferably lie exactly at the center of the reciprocal faces. In general, p-sided polygonal panels are reciprocated with p-valent vertices, where the valency of a vertex is determined by the number of edges or faces meeting at it. This reciprocation provides a way for the strength of a face on one layer to be complemented by the strength of the corresponding vertex on its dual layer. The structural principle is that faces with larger number of sides and constructed from the same thickness of material are progressively less stiff than those with fewer sides. This is because the centers of the faces are at a further distance from the bounding edges and vertices as the number of sides increase, and these boundary elements determine the stiffness of the panel especially when the panels are stitched or welded together at the edges and vertices. A similar principle applies to the strength of the vertices which derive their strength from the valency or number of edges meeting at them. The larger this number, the stronger is the vertex. Thus a face with fewer sides is relatively stronger yet its dual, with fewer edges meeting at it, is relatively weaker. When the two conditions are superimposed, we get a ball design where the strengths of one layer are compensated by the weakness in the other layer, and vice versa. This leads to a more uniformly strong ball surface. The following examples show this duality principle applied to seven different exemplary embodiments; and other designs in accordance with the present invention can be similarly derived using two or more layers. The designs could have either/any of the two or more layers as the exterior layer.

Figure 16:
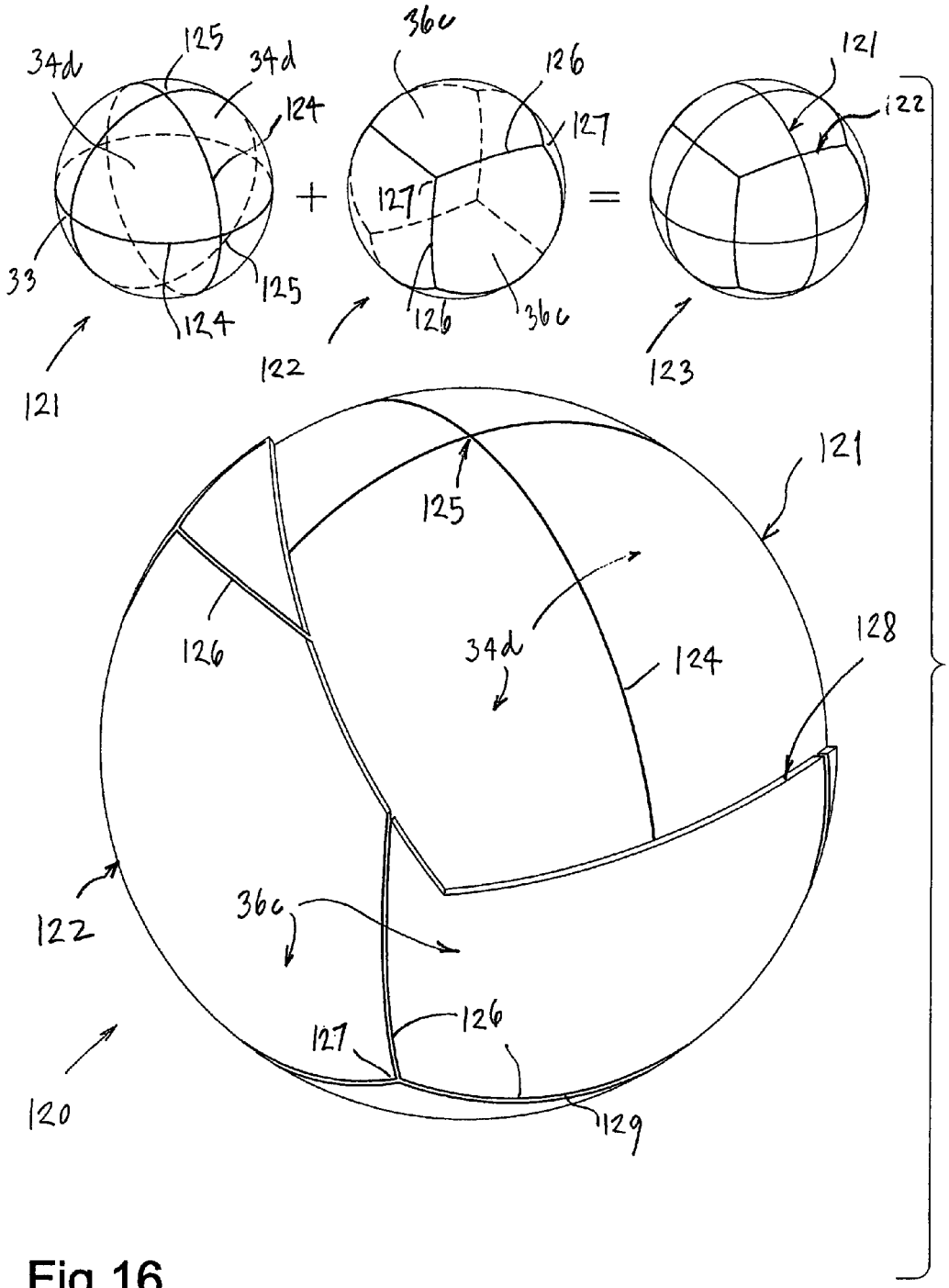
FIG. 16 shows a double-layer ball design by superimposing the spherical cube on the outer layer with its dual, the spherical octahedron, on the inner layer.

FIG. 16 shows a double-layer ball design 120 obtained by superimposing the spherical cube 122 on the outer layer with its dual, the spherical octahedron 121, on the inner layer.

Spherical octahedron 121 has eight spherical triangular panels 34*d* (p=3) meeting at twelve singly-curved edges 124 and six vertices 125. Spherical cube 122 is its topological dual and has eight vertices 127 that correspond to and lie at the centers of panels 34*d*, six 4-sided panels 36*c* (p=4) whose centers match vertices 125, and twelve edges 126 which are perpendicular to edges 124. The 3-valent vertices of spherical cube 122 overlay the 3-sided panels of spherical octahedron 121, and the 4-valent vertices of spherical octahedron 121 overlay the 4-sided panels of spherical cube 122. In design embodiment 120, the panels in the outer layer are shown with a material thickness 128 and a seam width 129.

Figure 17:
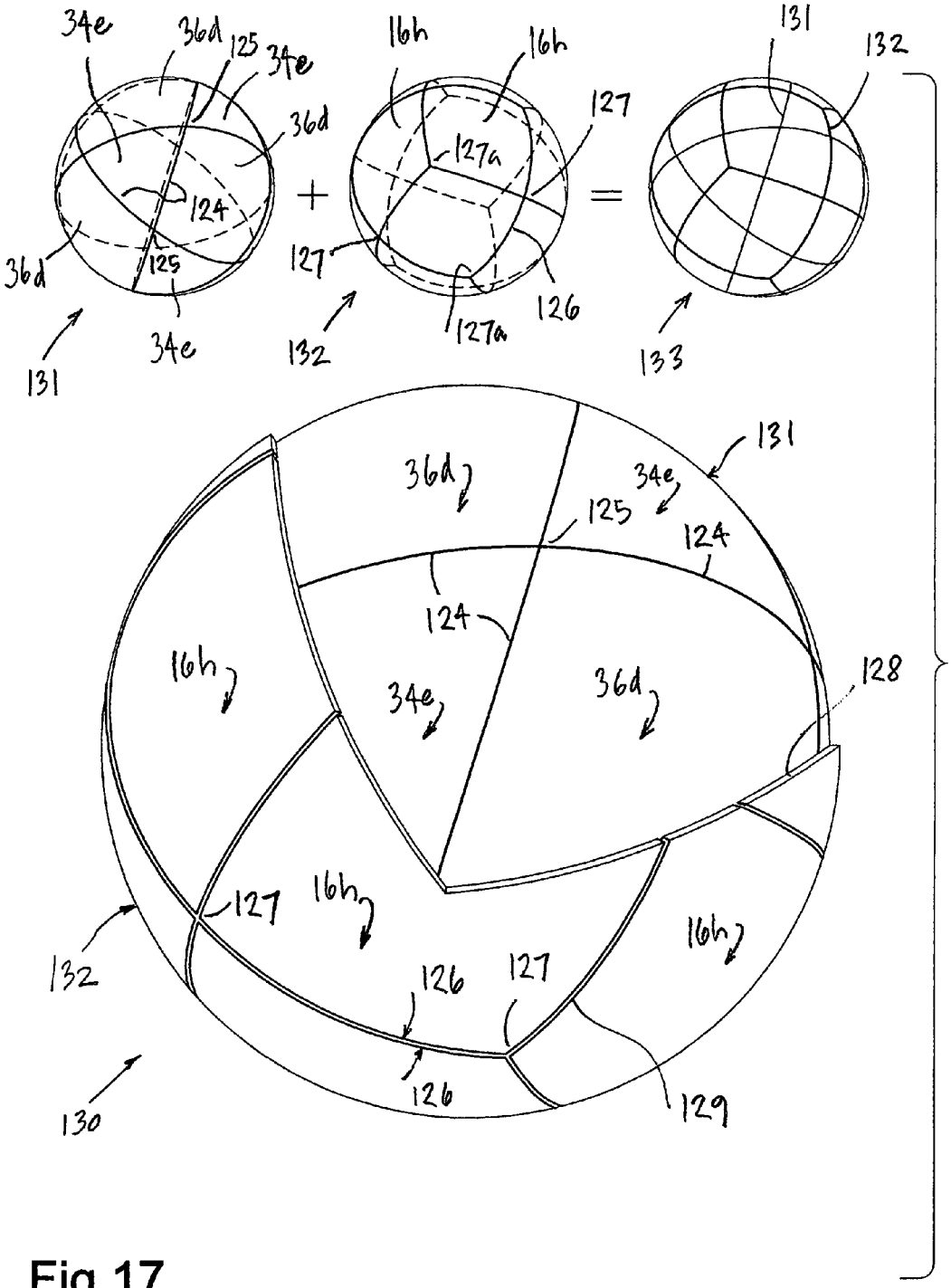
FIG. 17 shows a double-layer ball design by superimposing the spherical rhombic dodecahedron on the outer layer with its dual, the spherical cuboctahedron, on the inner layer.

FIG. 17 shows a double-layer ball design 130 by superimposing the spherical rhombic dodecahedron 132 on the outer layer with its dual, the spherical cuboctahedron 131, on the inner layer.

Spherical cuboctahedron 131 has fourteen panels comprising eight spherical triangular panels 34*e* (p=3) and six spherical square panels 36*d* (p=4) meeting at twenty-four singly-curved edges 124 and twelve vertices 125. Spherical rhombic dodecahedron 132 is its topological dual and has fourteen vertices, six of vertices 127 that correspond to and lie at the centers of panels 36*d* and eight of vertices 127*a* that correspond to the centers of panels 34*e*, twelve spherical rhombic panels 16*h* (p=4) whose centers match vertices 125, and twenty-four edges 126 which are perpendicular to edges 124. The 3-valent vertices of spherical rhombic dodecahedron 132 overlay the 3-sided panels of spherical cuboctahedron 131, the 4-valent vertices of spherical rhombic dodecahedron 132 overlay the 4-sided panels of spherical cuboctahedron 131. Reciprocally, the 4-valent vertices of spherical cuboctahedron 131 overlay the 4-sided panels of spherical rhombic dodecahedron 132. In design embodiment 130, the panels in the outer layer are shown with a material thickness 128 and a seam width 129.

Figure 18:
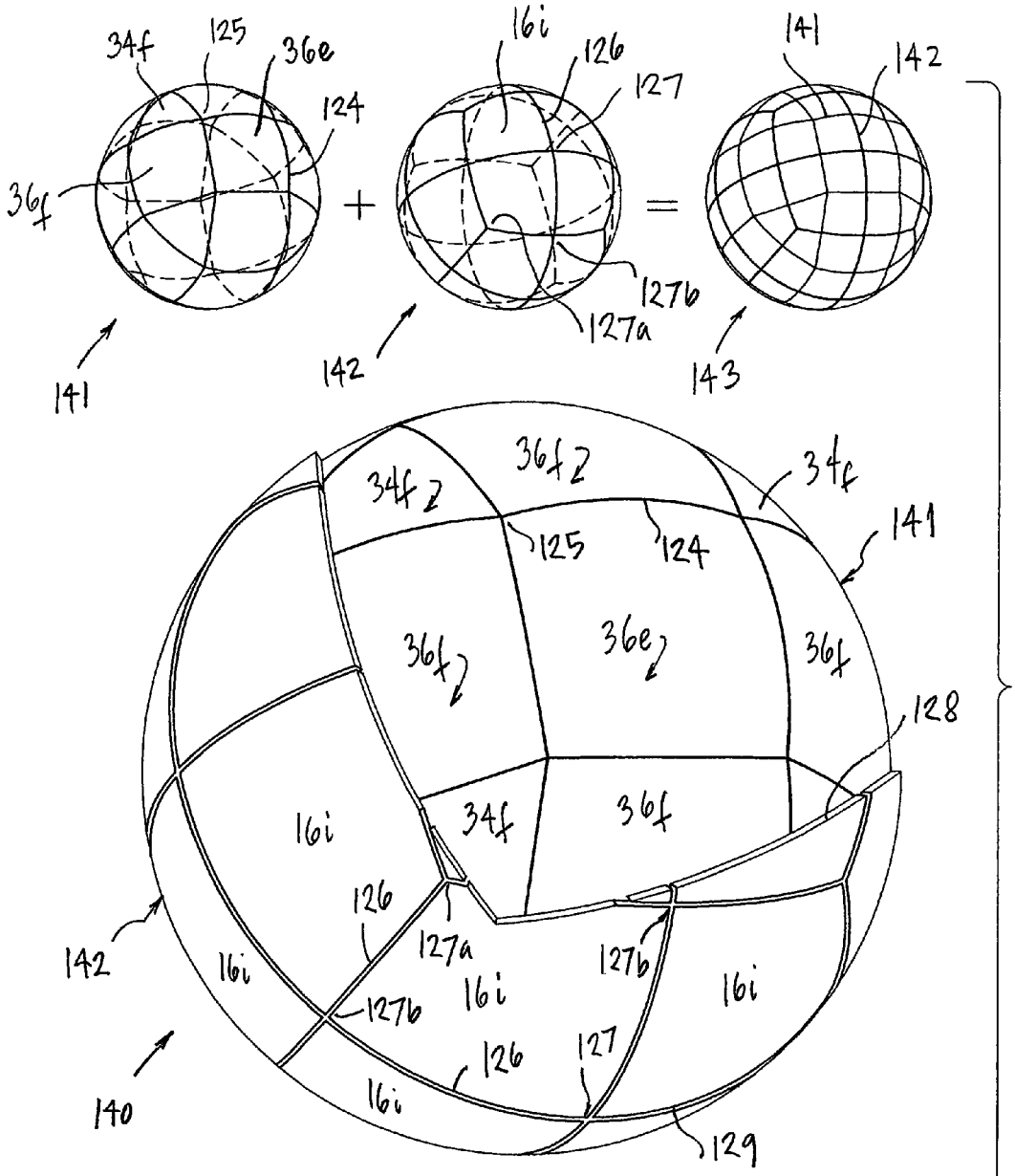
FIG. 18 shows a double-layer ball design by superimposing the spherical trapezoidal icositetrahedron on the outer layer with its dual, the spherical rhombicuboctahedron, on the inner layer.

FIG. 18 shows a double-layer ball design 140 by superimposing the spherical trapezoidal icositetrahedron 142 on the outer layer with its dual, the spherical rhombicuboctahedron 141, on the inner layer.

Spherical rhombicuboctahedron 141 has twenty-six panels comprising eight spherical triangular panels 34*f* (p=3), six spherical square panels 36*d* (p=4), and twelve 4-sided (p=4) panels 36*f*, meeting at forty-eight singly-curved edges 124 and twenty-four vertices 125. Spherical trapezoidal icositetrahedron 142 is its topological dual and has twenty-six vertices, six of vertices 127 that correspond to and lie at the centers of panels 36*e*, eight of vertices 127*a* that correspond to the centers of panels 34*f*, and twelve of vertices 127*b* that correspond to panels 36*f*. It has twenty-four spherical trapezoidal panels 16*i* (p=4) whose centers match vertices 125, and forty-eight edges 126 which are perpendicular to edges 124. The 3-valent vertices of spherical trapezoidal icositetrahedron 142 overlay the 3-sided panels of spherical rhombicuboctahedron 141, the 4-valent vertices of spherical trapezoidal icositetrahedron 142 overlay the 4-sided panels of spherical rhombicuboctahedron 141. Reciprocally, the 4-valent vertices of spherical rhombicuboctahedron 141 overlay the 4-sided panels of spherical trapezoidal icositetrahedron 142. In design embodiment 140, the panels in the outer layer are shown with a material thickness 128 and a seam width 129.

Figure 19:
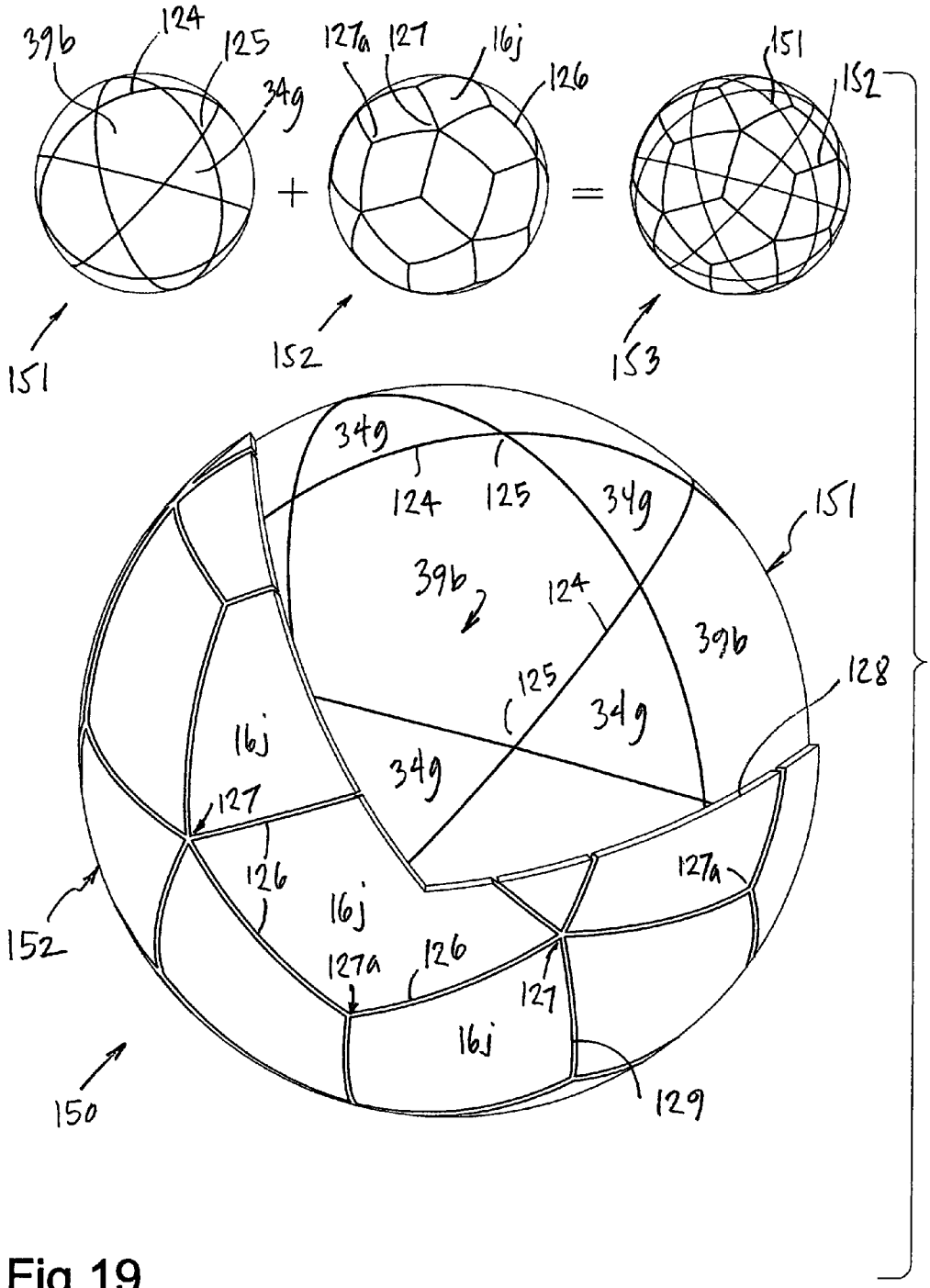
FIG. 19 shows a double-layer ball design by superimposing the spherical rhombic triacontahedron on the outer layer with its dual, the spherical icosidodecahedron, on the inner layer.

FIG. 19 shows a double-layer ball design 150 by superimposing the spherical rhombic triacontahedron 152 on the outer layer with its dual, the spherical icosidodecahedron 151, on the inner layer.

Spherical icosidodecahedron 151 has thirty-two panels comprising twenty spherical triangular panels 34*g* (p=3) and twelve spherical pentagonal panels 39*b* (p=5) meeting at sixty singly-curved edges 124 and thirty vertices 125. Spherical rhombic triacontahedron 152 is its topological dual and has thirty-two vertices, twelve of vertices 127 that correspond to and lie at the centers of panels 39*b* and twenty of vertices 127*a* that correspond to the centers of panels 34*g*. It has thirty spherical rhombic panels 16*j* (p=4) whose centers match vertices 125, and sixty edges 126 which are perpendicular to edges 124. The 3-valent vertices of spherical rhombic triacontahedron 152 overlay the 3-sided panels of spherical icosidodecahedron 151, the 5-valent vertices of spherical rhombic triacontahedron 152 overlay the 5-sided panels of spherical icosidodecahedron 151. Reciprocally, the 4-valent vertices of spherical icosidodecahedron 151 overlay the 4-sided panels of spherical rhombic triacontahedron 152. In design embodiment 150, the panels in the outer layer are shown with a material thickness 128 and a seam width 129.

Figure 20:
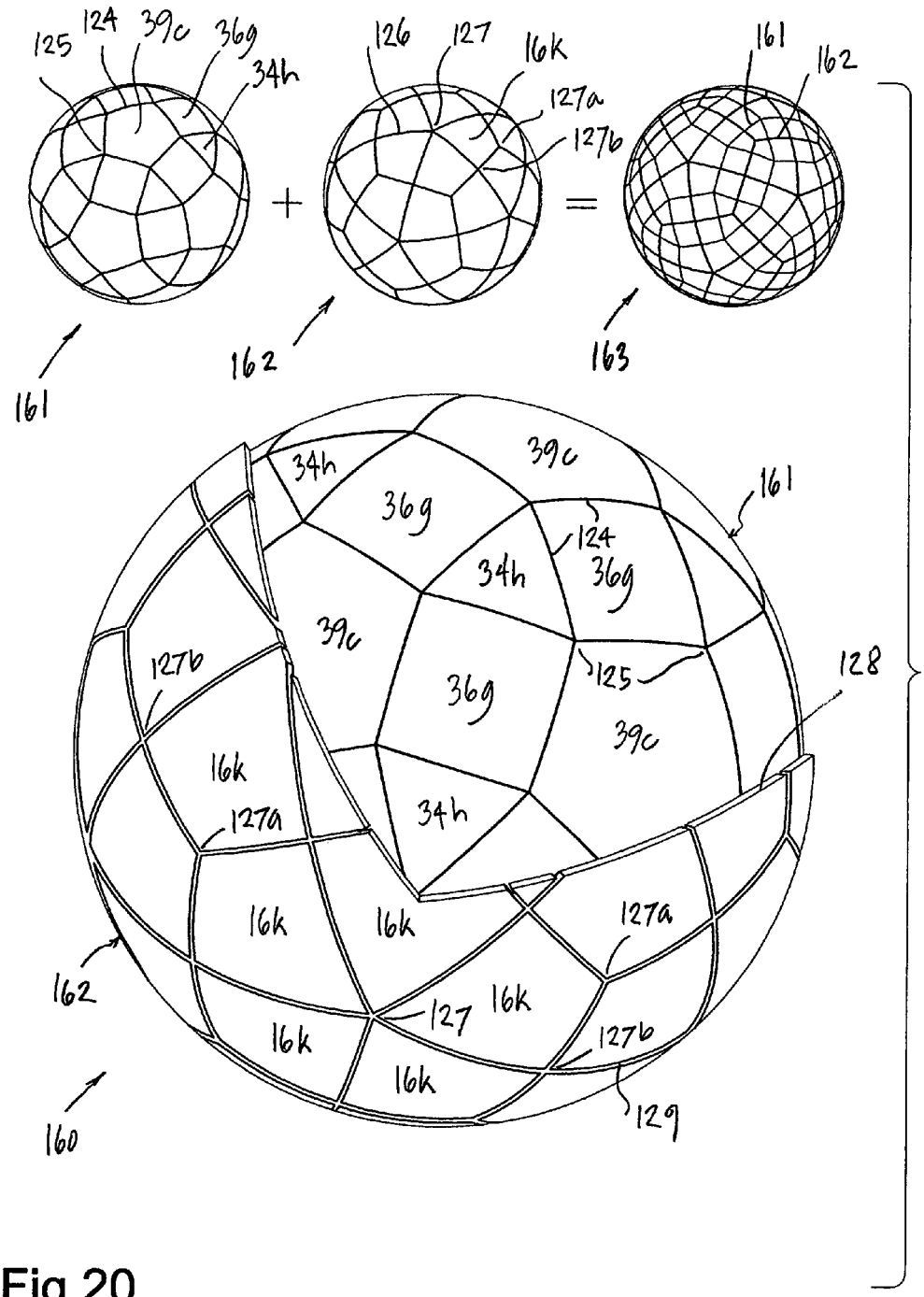
FIG. 20 shows a double-layer ball design by superimposing the trapezoidal hexecontahedron on the outer layer with its dual, the spherical rhombicosidodecahedron, on the inner layer.

FIG. 20 shows a double-layer ball design 160 by superimposing the trapezoidal hexecontahedron 162 on the outer layer with its dual, the spherical rhombicosidodecahedron 161, on the inner layer.

Spherical rhombicosidodecahedron 161 has sixty-two panels comprising twenty spherical triangular panels 34*h* (p=3), twelve spherical pentagonal panels 39*c* (p=5), and thirty 4-sided panels 36*g* (p=4), meeting at one hundred and twenty singly-curved edges 124 and sixty vertices 125. Trapezoidal hexecontahedron 162 is its topological dual and has sixty-two vertices, twelve of vertices 127 that correspond to and lie at the centers of panels 39*c*, twenty of vertices 127*a* that correspond to the centers of panels 34*h*, and thirty of vertices 127*b* that correspond to panels 36*g*. It has sixty spherical trapezoidal panels 16*k* (p=4) whose centers match vertices 125, and one hundred and twenty edges 126 which are perpendicular to edges 124. The 3-valent vertices of trapezoidal hexecontahedron 162 overlay the 3-sided panels of spherical rhombicosidodecahedron 161, the 4-valent vertices of trapezoidal hexecontahedron 162 overlay the 4-sided panels of spherical rhombicosidodecahedron 161 and the 5-valent vertices of trapezoidal hexecontahedron 162 overlay the 5-sided panels of spherical rhombicosidodecahedron 161. Reciprocally, the 4-valent vertices of spherical rhombicosidodecahedron 161 overlay the 4-sided panels of trapezoidal hexecontahedron 162. In design embodiment 160, the panels in the outer layer are shown with a material thickness 128 and a seam width 129.

Figure 21:
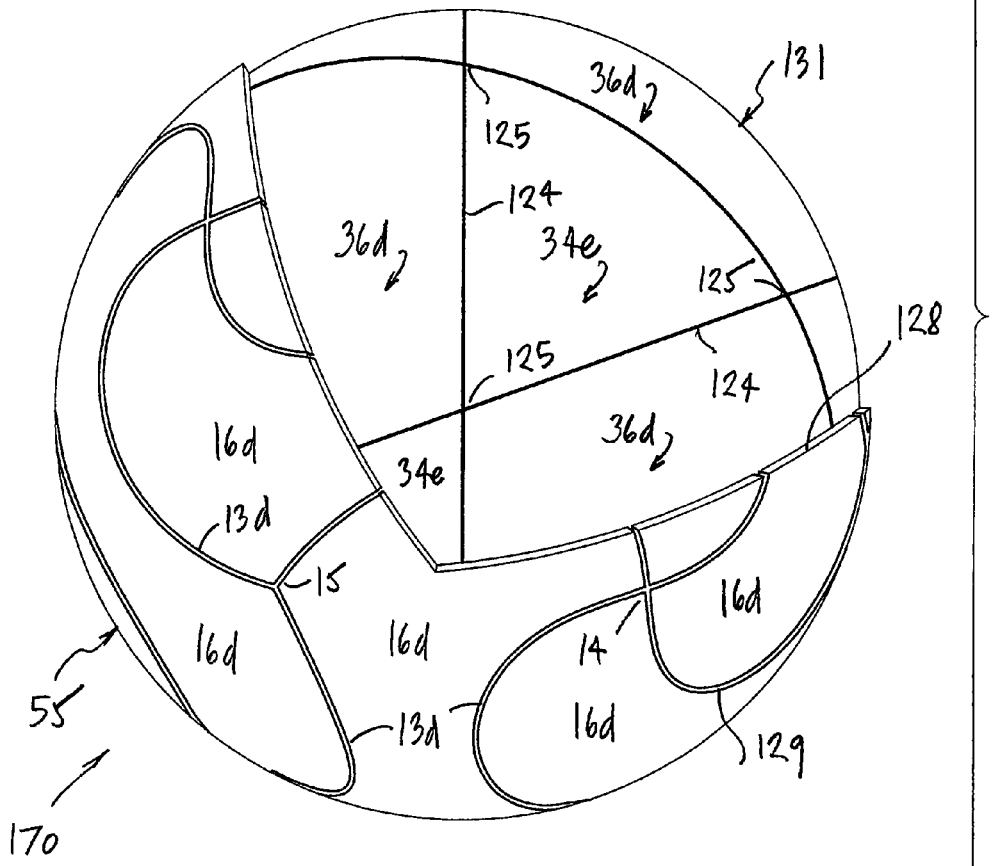
FIG. 21 shows a double-layer ball design by superimposing the ball shown in FIG. 3 on the exterior layer and a spherical octahedron on the inner layer.

FIG. 21 shows a double-layer ball design 170 by superimposing the ball 55 shown in FIG. 4 on the exterior layer and a spherical cuboctahedron 131 on the inner layer.

Figure 22:
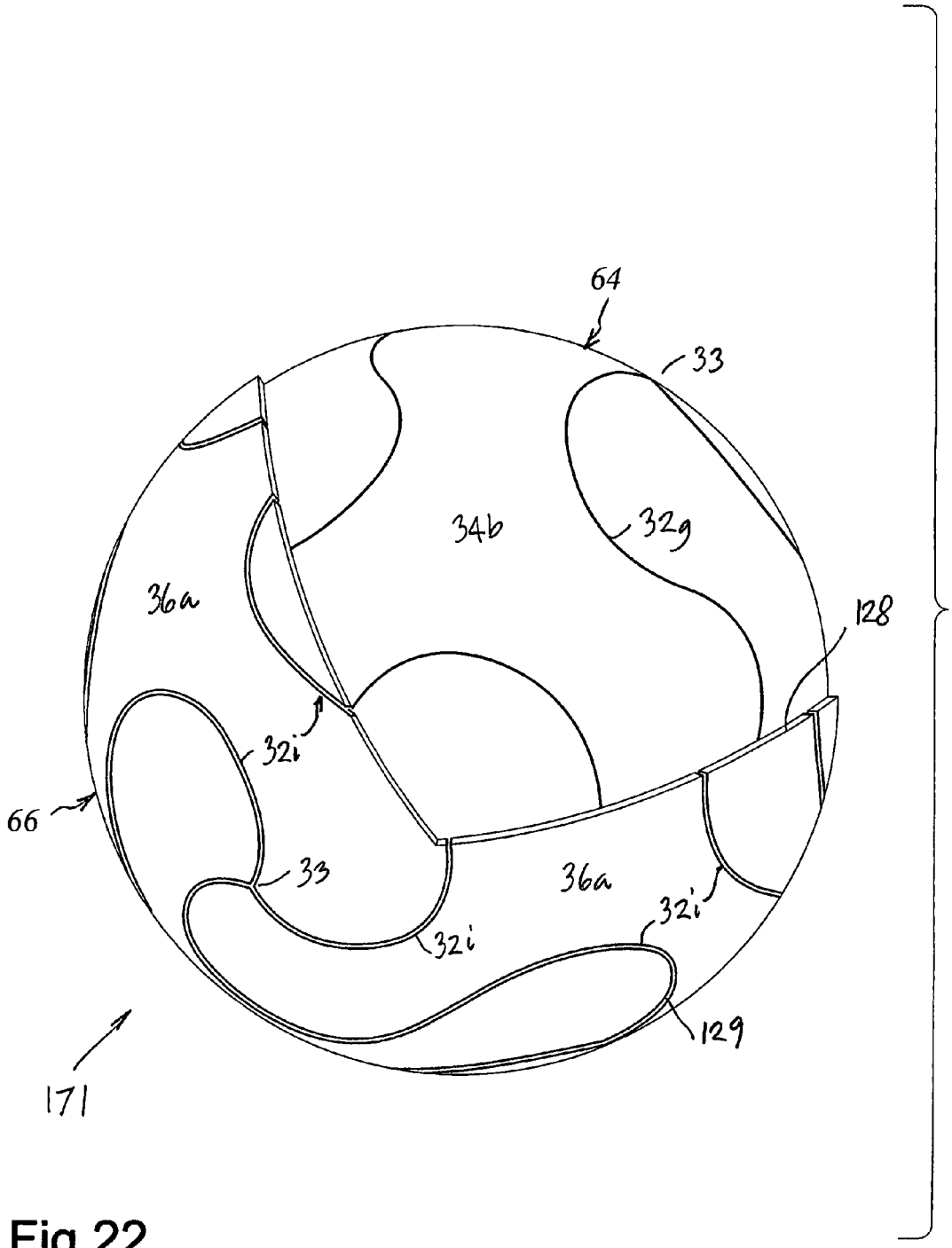
FIG. 22 shows a double-layer ball design by superimposing the ball shown in FIG. 11 on the exterior layer with the ball shown in FIG. 9 on the inner layer.

FIG. 22 shows a double-layer ball design 171 by superimposing the ball 66 shown in FIG. 11 on the exterior layer with the ball 64 shown in FIG. 9 on the inner layer.

Figure 23:
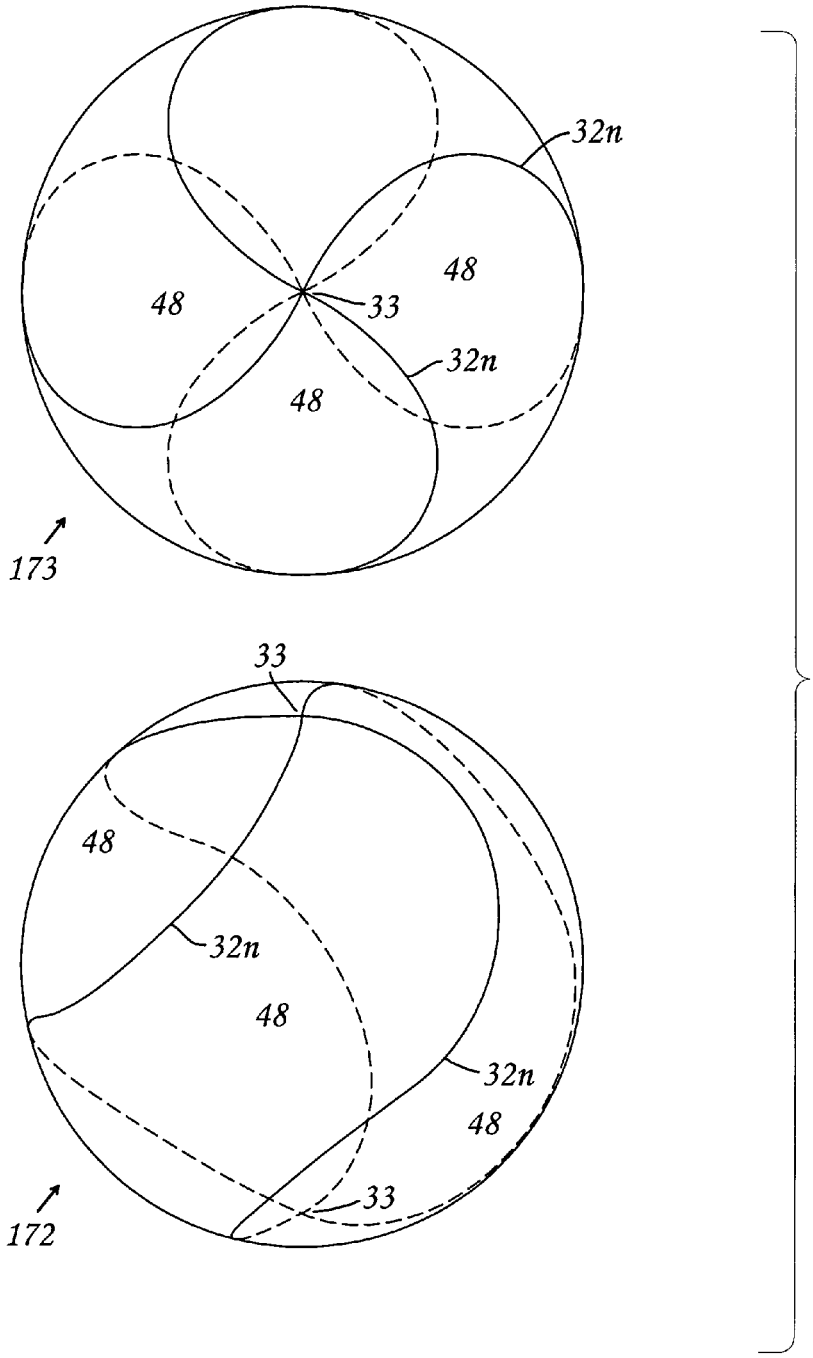
FIG. 23 shows a ball design, based on digonal polyhedra, having four identical 2-sided (p=2) panels having edges of Class 2.

FIG. 23 shows a ball 172, based on digonal polyhedra, having four identical 2-sided (p=2) panels 48 bound by two identical Class 2 edges 32*n* and two identical vertices 33. View 173 is of ball 172 around one of the vertices 33.

Figure 24:
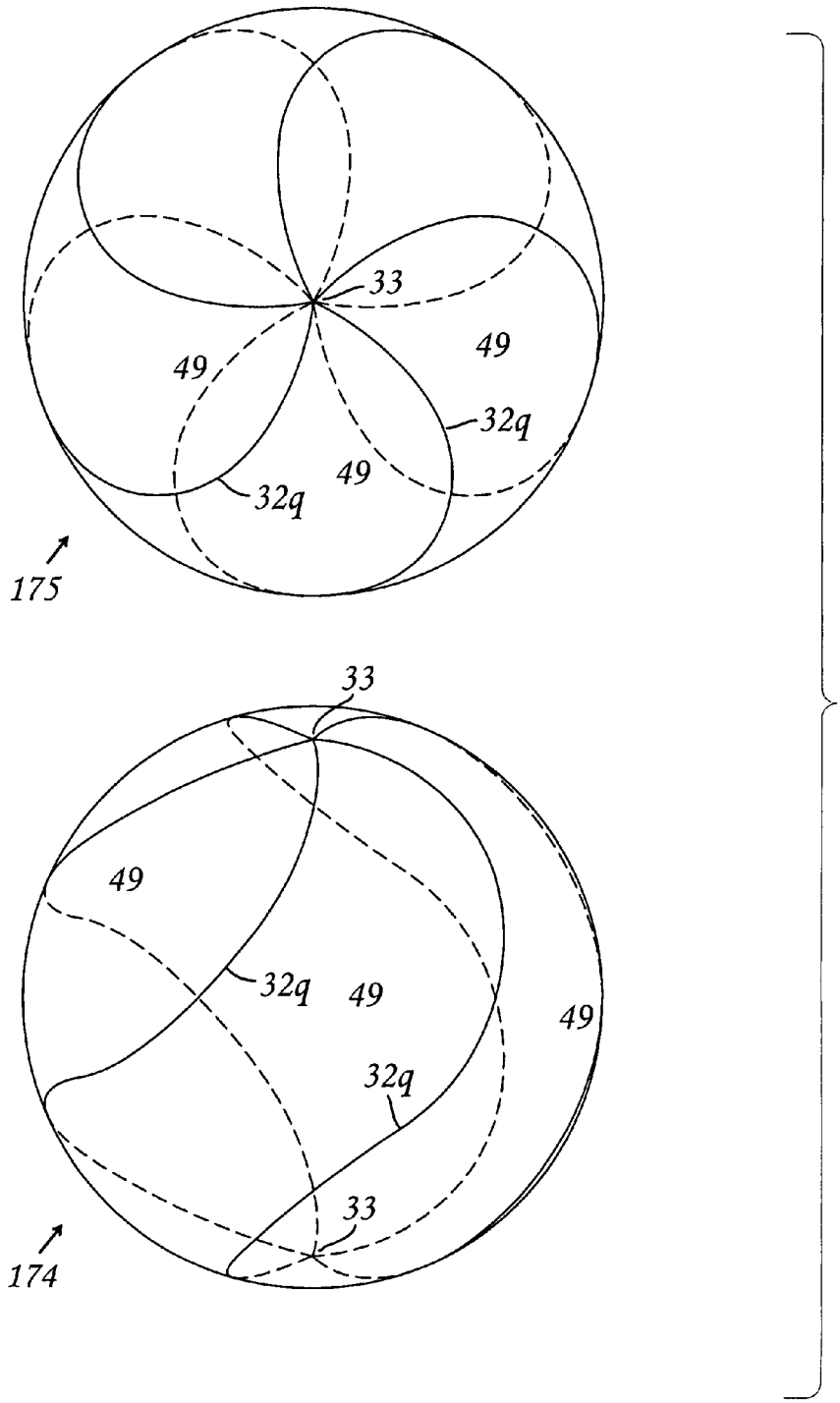
FIG. 24 shows a ball design, based on digonal polyhedra, having five identical 2-sided (p=2) panels having edges of Class 2.

FIG. 24 shows a ball 174, based on digonal polyhedra, having five identical 2-sided (p=2) panels 49 bound by two identical Class 2 edges 32*q* and two identical vertices 33. View 175 is of ball 174 around one of the vertices 33.

The balls can be constructed from any suitable materials and their sizes can be proportioned to the rules of any game as well as any domestic or international standards. In the case of soccer balls, the panels could be constructed from a suitable material such as leather, for example, which can be cut into desired panel shapes and stretched in the forming process to conform to the ball surface. There are numerous ways by which the panels can be joined together. For example, the panels can be seamed together by stitching the edges of the panels where they meet. The panels can also be molded in their final form and joined by laser-welding, especially when constructed from suitable plastic materials laminates. Those skilled in the art will realize that there are numerous materials that may be used to construct the layers of the balls as well as numerous means by which the panels can be joined together. The invention disclosed herein covers all such materials and means of joining, whether currently known or hereafter developed.

What is claimed is:

1. A sports ball comprising:

at least six identical 4-sided polygonal panels, each said panel having 4 curved edges and 4 vertices, each said edge being bound by two said vertices, wherein said curved edges are either convex or concave and arranged such that each said convex edge alternates with each said concave edge, wherein said curved edges are arranged cyclically around said vertices such that said concave edge of one said polygonal panel mates with said concave edge of adjacent said polygonal panel, and wherein said curved edges are asymmetric, said asymmetry of said curved edge enabling a more uniform width of said 4-sided polygonal panel; the ball further comprising an outer layer and an inner layer, said inner layer is the topological dual of said outer layer and oriented so that the vertices of said outer layer overlay the panels of said inner layer, and said polygonal panels of said outer layer overlay the vertices of said inner layer.

2. The sports ball as recited in claim 1 wherein the ball is spherical in shape.

3. The sports ball as recited in claim 1 wherein the ball is ellipsoidal in shape.

4. The sports ball as recited in claim 1 wherein the ball wherein a starting geometry is a polyhedron having a single type of polygon.

5. The sports ball as recited in claim 4 wherein the polyhedron having a single type of polygon is selected from the group consisting of regular polyhedra, zonohedra (polyhedron having parallelograms and rhombuses), Archimedean duals (duals of semi-regular or Archimedean polyhedra) and composite polyhedra obtained by superimposing two dual polyhedra.

6. The sports ball as recited in claim 1 further comprising an outer layer and at least one inner layer wherein the panels of each next layer are smaller in size than the panels of each previous inner layer and the outer layer.

7. The sports ball as recited in claim 1 further comprising a solid interior.

* * * * *

UNITED STATES PATENT AND TRADEMARK OFFICE

CERTIFICATE OF CORRECTION

PATENT NO. : 7,854,671 B2
APPLICATION NO. : 11/796734
DATED : December 21, 2010
INVENTOR(S) : Haresh Lalvani It is certified that error appears in the above-identified patent and that said Letters Patent is hereby corrected as shown below:

In claim 1, please replace "concave" with "convex" in claim 1, at column 12, line 44:

"1. A sports ball comprising:
at least six identical 4-sided polygonal panels, each said panel having 4 curved edges and 4 vertices, each said edge being bound by two said vertices, wherein
said curved edges are either convex or concave and arranged such that each said convex edge alternates with each said concave edge, wherein
said curved edges are arranged cyclically around said vertices such that said concave edge of one said polygonal panel mates with said ~~concave~~ <u>convex</u> edge of adjacent said polygonal panel, and wherein
said curved edges are asymmetric, said asymmetry of said curved edge enabling a more uniform width of said 4-sided polygonal panel; the ball further comprising an outer layer and an inner layer, said inner layer is the topological dual of said outer layer and oriented so that the vertices of said outer layer overlay the panels of said inner layer, and said polygonal panels of said outer layer overlay the vertices of said inner layer."

Signed and Sealed this
Thirteenth Day of September, 2011

David J. Kappos

David J. Kappos
*Director of the United States Patent and Trademark Office*